US010274853B2

(12) United States Patent
Itoh et al.

(10) Patent No.: US 10,274,853 B2
(45) Date of Patent: Apr. 30, 2019

(54) TONER, DEVELOPER, TONER HOUSING UNIT AND IMAGE FORMING APPARATUS

(71) Applicants: Takayuki Itoh, Kanagawa (JP); Naohiro Watanabe, Shizuoka (JP); Takahiro Honda, Shizuoka (JP); Shingo Sakashita, Shizuoka (JP); Daisuke Inoue, Shizuoka (JP); Rintaro Takahashi, Kanagawa (JP); Ayumi Satoh, Shizuoka (JP)

(72) Inventors: Takayuki Itoh, Kanagawa (JP); Naohiro Watanabe, Shizuoka (JP); Takahiro Honda, Shizuoka (JP); Shingo Sakashita, Shizuoka (JP); Daisuke Inoue, Shizuoka (JP); Rintaro Takahashi, Kanagawa (JP); Ayumi Satoh, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/188,088

(22) Filed: Jun. 21, 2016

(65) Prior Publication Data

US 2016/0378006 A1 Dec. 29, 2016

(30) Foreign Application Priority Data

Jun. 29, 2015 (JP) ..... 2015-129877

(51) Int. Cl.

| | |
|---|---|
| ***G03G 9/087*** | (2006.01) |
| ***G03G 15/08*** | (2006.01) |
| ***G03G 9/097*** | (2006.01) |
| ***G03G 9/08*** | (2006.01) |

(52) U.S. Cl.

CPC ..... *G03G 9/08755* (2013.01); *G03G 9/0821* (2013.01); *G03G 9/09725* (2013.01); *G03G 15/0865* (2013.01)

(58) Field of Classification Search

CPC ..... G03G 9/0821; G03G 9/09725; G03G 9/08755

See application file for complete search history.

(56) References Cited

U.S. PATENT DOCUMENTS

| | | | | |
|---|---|---|---|---|
| 7,056,638 | B1 | 6/2006 | Tomita et al. | |
| 8,795,938 | B2 * | 8/2014 | Uchinokura | G03G 9/08 430/108.3 |
| 2003/0027074 | A1 | 2/2003 | Emoto et al. | |
| 2003/0104297 | A1 * | 6/2003 | Matsuda | G03G 9/0819 430/108.3 |
| 2003/0134220 | A1 | 7/2003 | Emoto et al. | |
| 2003/0138717 | A1 | 7/2003 | Yagi et al. | |
| 2003/0152859 | A1 | 8/2003 | Emoto et al. | |
| 2003/0162112 | A1 | 8/2003 | Yamashita et al. | |
| 2003/0180644 | A1 | 9/2003 | Nanya et al. | |
| 2004/0131961 | A1 | 7/2004 | Watanabe et al. | |
| 2004/0142264 | A1 | 7/2004 | Tanaka et al. | |
| 2004/0146795 | A1 | 7/2004 | Emoto et al. | |
| 2004/0157146 | A1 | 8/2004 | Tomita et al. | |
| 2004/0175641 | A1 | 9/2004 | Nanya et al. | |
| 2004/0209181 | A1 | 10/2004 | Higuchi et al. | |
| 2004/0229147 | A1 | 11/2004 | Higuchi et al. | |
| 2004/0265721 | A1 | 12/2004 | Matsuoka et al. | |
| 2005/0003291 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1 | 2/2005 | Tanaka et al. | |
| 2005/0112488 | A1 | 5/2005 | Yamada et al. | |
| 2005/0164112 | A1 | 7/2005 | Ohki et al. | |
| 2005/0164114 | A1 | 7/2005 | Yagi et al. | |
| 2005/0186498 | A1 | 8/2005 | Honda et al. | |
| 2005/0277044 | A1 | 12/2005 | Watanabe et al. | |
| 2005/0277045 | A1 | 12/2005 | Saito et al. | |
| 2006/0046174 | A1 | 3/2006 | Ohki et al. | |
| 2006/0057488 | A1 | 3/2006 | Inoue et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0204883 | A1 | 9/2006 | Nakayama et al. | |
| 2006/0210903 | A1 | 9/2006 | Ohki et al. | |
| 2006/0240349 | A1 | 10/2006 | Watanabe et al. | |
| 2006/0245794 | A1 | 11/2006 | Honda et al. | |

(Continued)

FOREIGN PATENT DOCUMENTS

| | | | |
|---|---|---|---|
| EP | 1220043 A2 * | 7/2002 | G03G 9/0806 |
| JP | 2000-330325 | 11/2000 | |

(Continued)

OTHER PUBLICATIONS

"Vibracell Ultrasonic Liquid Processors" Sonics & Materials, Inc. (Mar. 2017) 31 pages.*

"Surface tension values of some common test liquids for surface energy analysis" Retrieved Apr. 6, 2017 from www.surface-tension.de (4 pages).*

Shree Mahalaxmi Chemicals, DAI ICHI 'S Noigen Surfactants NOIGEN ET-165 Web Page. www.shreemahalaxmichemicals.com/dai-ichi-s-noigen-surfactants.html (retrieved Dec. 7, 2017).*

A brochure of nonionic surfactants issued by DKS Co., Ltd. with partial English translation.

*Primary Examiner* — Christopher D RoDee

(74) *Attorney, Agent, or Firm* — Oblon, McClelland, Maier & Neustadt, L.L.P.

(57) ABSTRACT

A toner includes a binder resin; a release agent; and two or more inorganic fine particles as external additives. At least one of the inorganic fine particles is silica. When an ultrasonic oscillation is applied to a dispersion including the toner and a dispersant and a rate of the silica releasing from the toner is 20% based on total silica, an application energy of the ultrasonic oscillation is from 8 to 14 kJ, and from 70 to 130 kJ when the rate of the silica releasing from the toner is 50%.

8 Claims, 6 Drawing Sheets

(56) References Cited

U.S. PATENT DOCUMENTS

2006/0251979 A1 11/2006 Watanabe et al.
2006/0269860 A1 11/2006 Nanya et al.
2007/0031752 A1 2/2007 Watanabe et al.
2007/0037085 A1 2/2007 Ishii et al.
2007/0042284 A1 2/2007 Takada et al.
2007/0054210 A1 3/2007 Ohki et al.
2007/0059626 A1 3/2007 Inoue et al.
2007/0141506 A1 6/2007 Inoue et al.
2007/0218380 A1 9/2007 Uchinokura et al.
2007/0218381 A1 9/2007 Uchinokura et al.
2007/0218382 A1 9/2007 Emoto et al.
2007/0218389 A1 9/2007 Honda et al.
2007/0218392 A1 9/2007 Yamada et al.
2008/0063971 A1 3/2008 Watanabe et al.
2008/0069616 A1 3/2008 Kojima et al.
2008/0070144 A1 3/2008 Nagatomo et al.
2008/0090165 A1 4/2008 Yamada et al.
2008/0138734 A1 6/2008 Inoue et al.
2008/0226998 A1 9/2008 Ishii et al.
2008/0227000 A1 9/2008 Honda et al.
2008/0227003 A1 9/2008 Honda et al.
2008/0233495 A1 9/2008 Ishii et al.
2008/0233505 A1 9/2008 Nagatomo et al.
2008/0268366 A1 10/2008 Nakayama et al.
2008/0280224 A1 11/2008 Inoue et al.
2008/0286679 A1 11/2008 Norikane et al.
2008/0292985 A1 11/2008 Suzuki et al.
2008/0318144 A1 12/2008 Watanabe et al.
2009/0017392 A1 1/2009 Higuchi et al.
2009/0074467 A1 3/2009 Seshita et al.
2009/0092917 A1 4/2009 Sugimoto et al.
2009/0104555 A1 4/2009 Wakamatsu et al.
2009/0117480 A1 5/2009 Yamada et al.
2009/0117486 A1 5/2009 Watanabe et al.
2009/0123186 A1 5/2009 Sugiura et al.
2009/0155709 A1 6/2009 Watanabe et al.
2009/0186292 A1 7/2009 Inoue et al.
2009/0202935 A1 8/2009 Moriya et al.
2009/0214973 A1 8/2009 Sugimoto et al.
2009/0233204 A1 9/2009 Watanabe et al.
2009/0239170 A1 9/2009 Honda et al.
2009/0317738 A1 12/2009 Honda et al.
2009/0325099 A1 12/2009 Watanabe et al.
2009/0325100 A1 12/2009 Watanabe et al.
2010/0003613 A1 1/2010 Honda et al.
2010/0021209 A1 1/2010 Watanabe et al.
2010/0035170 A1 2/2010 Sugimoto et al.
2010/0055590 A1 3/2010 Honda et al.
2010/0061759 A1 3/2010 Moriya et al.
2010/0075243 A1 3/2010 Shimota et al.
2010/0075245 A1 3/2010 Watanabe et al.
2010/0081075 A1 4/2010 Watanabe et al.
2010/0129748 A1 5/2010 Inoue et al.
2010/0183967 A1 7/2010 Sabu et al.
2010/0216068 A1 8/2010 Kotsugai et al.
2010/0233609 A1 9/2010 Higuchi et al.
2010/0297548 A1 11/2010 Honda et al.
2010/0330489 A1 12/2010 Inoue et al.
2011/0003244 A1 1/2011 Inoue et al.
2011/0033794 A1 2/2011 Watanabe et al.
2011/0065033 A1 3/2011 Uchinokura et al.
2011/0065036 A1 3/2011 Inoue et al.
2011/0076607 A1 3/2011 Sugimoto et al.
2011/0081608 A1 4/2011 Yaguchi et al.
2011/0086308 A1 4/2011 Watanabe et al.
2011/0104608 A1 5/2011 Nakajima et al.
2011/0124838 A1 5/2011 Kotsugai et al.
2011/0129773 A1 6/2011 Shu et al.
2011/0151370 A1 6/2011 Shitara et al.
2011/0151372 A1 6/2011 Watanabe et al.
2011/0200928 A1 8/2011 Watanabe et al.
2011/0223530 A1 9/2011 Inoue et al.
2011/0223532 A1 9/2011 Sugimoto et al.
2011/0255899 A1 10/2011 Iwamoto et al.
2011/0262856 A1 10/2011 Sugimoto et al.
2011/0281213 A1 11/2011 Sakashita et al.
2011/0294058 A1 12/2011 Shiba et al.
2011/0305986 A1 12/2011 Ogawa et al.
2012/0021347 A1 1/2012 Shimota et al.
2012/0052431 A1 3/2012 Hozumi et al.
2012/0052434 A1 3/2012 Sugimoto et al.
2012/0064445 A1 3/2012 Kojima et al.
2012/0064447 A1 3/2012 Hozumi et al.
2012/0082926 A1 4/2012 Suzuki et al.
2012/0122027 A1 5/2012 Watanabe et al.
2012/0189951 A1 7/2012 Sugimoto et al.
2012/0202147 A1 8/2012 Suzuki et al.
2012/0219896 A1 8/2012 Asahina et al.
2012/0264043 A1 10/2012 Watanabe et al.
2012/0288299 A1 11/2012 Uchinokura et al.
2012/0288791 A1 11/2012 Sakashita et al.
2012/0295193 A1 11/2012 Hanatani et al.
2013/0011778 A1 1/2013 Yamashita et al.
2013/0017480 A1 1/2013 Suzuki et al.
2013/0022371 A1 1/2013 Kusahara et al.
2013/0059247 A1 3/2013 Sugimoto et al.
2013/0130171 A1 5/2013 Watanabe et al.
2013/0157183 A1 6/2013 Santo et al.
2013/0157184 A1 6/2013 Sugimoto et al.
2013/0157185 A1 6/2013 Sakashita et al.
2013/0157193 A1 6/2013 Moritani et al.
2013/0171554 A1 7/2013 Yamashita et al.
2013/0171557 A1 7/2013 Watanabe et al.
2013/0177846 A1 7/2013 Watanabe et al.
2013/0196260 A1 8/2013 Yoshida et al.
2013/0196261 A1 8/2013 Uchinokura et al.
2013/0196263 A1 8/2013 Asahina et al.
2013/0196266 A1 8/2013 Watanabe et al.
2013/0209931 A1 8/2013 Sato et al.
2013/0224648 A1 8/2013 Honda et al.
2013/0236826 A1 9/2013 Makabe et al.
2013/0243488 A1 9/2013 Kojima et al.
2013/0244154 A1 9/2013 Yamamoto et al.
2013/0244155 A1 9/2013 Satoh et al.
2013/0244156 A1 9/2013 Kojima et al.
2013/0244158 A1 9/2013 Awamura et al.
2013/0252158 A1 9/2013 Yamada et al.
2013/0316280 A1 11/2013 Yoshida et al.
2014/0072349 A1 3/2014 Sakashita et al.
2014/0080046 A1 3/2014 Asahina et al.
2014/0080047 A1 3/2014 Takahashi et al.
2014/0093820 A1 4/2014 Satoh et al.
2014/0140731 A1 5/2014 Hozumi et al.
2014/0220485 A1* 8/2014 Kojima ..... G03G 9/0804 430/105
2014/0234767 A1 8/2014 Awamura et al.
2014/0301757 A1 10/2014 Sakashita et al.
2014/0348545 A1 11/2014 Shiba et al.
2014/0348546 A1 11/2014 Kojima et al.
2015/0024312 A1 1/2015 Shiba et al.
2015/0037718 A1 2/2015 Morita et al.
2015/0104739 A1 4/2015 Nagatomo et al.
2015/0198902 A1 7/2015 Saito et al.
2015/0227071 A1 8/2015 Sakashita et al.
2015/0234304 A1 8/2015 Nagata et al.
2015/0261144 A1 9/2015 Sakashita et al.

FOREIGN PATENT DOCUMENTS

JP 2002-062683 2/2002
JP 2002-082484 3/2002
JP 2006-267734 A 10/2006
JP 2007-298993 A 11/2007
JP 2009-015083 1/2009
JP 2009-093992 4/2009
JP 2011-043759 3/2011
JP 2011-180510 9/2011
JP 2013-064819 4/2013
JP 2013-156489 A 8/2013
JP 2014-164034 A 9/2014
JP 2015-001721 A 1/2015
JP 2017-015817 A 1/2017

* cited by examiner

TONER, DEVELOPER, TONER HOUSING UNIT AND IMAGE FORMING APPARATUS

CROSS-REFERENCE TO RELATED APPLICATIONS

This patent application is based on and claims priority pursuant to 35 U.S.C. § 119 to Japanese Patent Application No. 2015-129877, filed on Jun. 29, 2015, in the Japan Patent Office, the entire disclosure of which is hereby incorporated by reference herein.

BACKGROUND

Technical Field

The present invention relates to a toner, a developer, a toner housing unit and an image forming apparatus.

Description of the Related Art

Conventionally, electrophotographic image formation forms an electrostatic latent image on an image bearer such as photoconductive materials and transfers charged toner particles onto the electrostatic latent image to form a visible image. The visible image formed of the toner is finally transferred onto a transfer medium such as papers, and then fixed by a heat, a pressure, a solvent air, etc. thereon. A toner remaining on the image bearer after transferred is collected by a cleaning member and discharged in a waste toner storage.

Recently, since image forming apparatuses fixing images with heat need much electric power in the process of melting a toner with heat and fixing the toner on a recording medium such as papers, low-temperature fixability has been one of important properties for the toner to save energy.

As a method of improving charge stability and heat resistant preservability of a toner, the surface of a base toner is covered by various methods, e.g., a method of applying an external additive such as inorganic or organic fine particles to the surface thereof to suppress deterioration of chargeability of the toner under high humidity and improve preservability and fluidity with spacer effect is known.

Further, it is important for a toner used in recent ultrahigh speed printing systems to have stable chargeability and heat resistant preservability for continuing to produce images having constant image quality even when exposed severe working conditions such as variation of environmental temperature and humidity and continuous production of a large amount of images. Therefore, many inventions about varieties, properties and formulations of the external additives are disclosed.

Adhesive strength of the external additive to a base toner is known to influence on the toner quality. When the adhesive strength is low and many external additives are easy to release from the base toner, the free external additive causes filming over a photoconductor. When the adhesive strength is high, spacer effect cannot be expected, resulting in deterioration of preservability and toner scattering due to carrier spent of the base toner components.

SUMMARY

A toner includes a binder resin; a release agent; and two or more inorganic fine particles as external additives. At least one of the inorganic fine particles is silica. When an ultrasonic oscillation is applied to a dispersion including the toner and a dispersant and a rate of the silica releasing from the toner is 20% based on total silica, an application energy of the ultrasonic oscillation is from 8 to 14 kJ, and from 70 to 130 kJ when the rate of the silica releasing from the toner is 50%.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
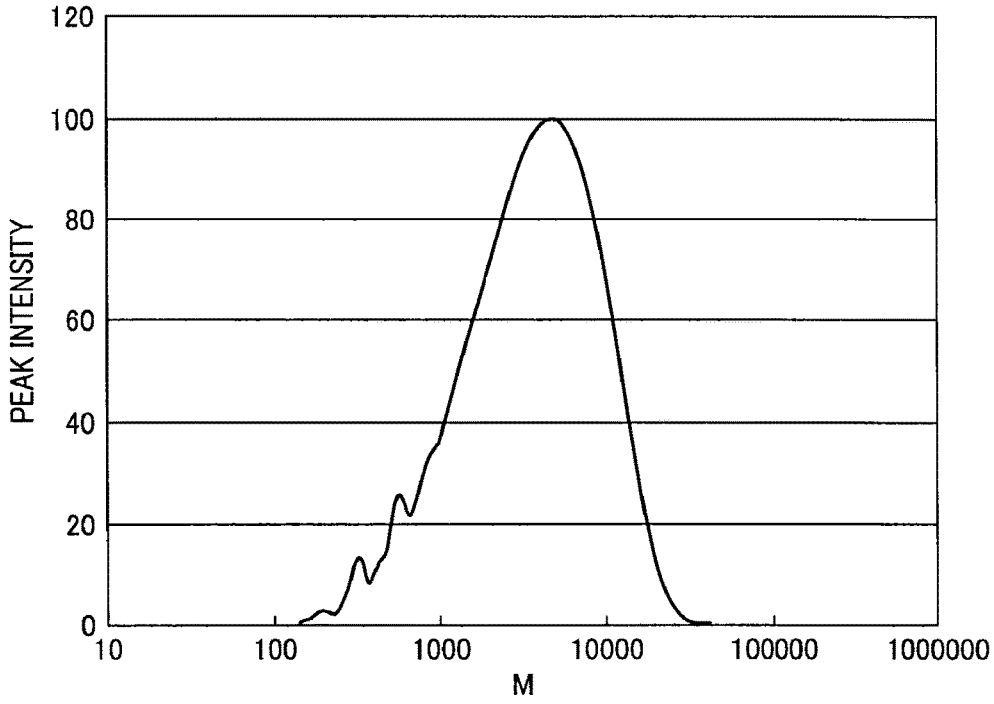
FIG. 1 is a schematic explanatory graph illustrating an embodiment of GPC measurement of the toner of the present invention.

There is a need for a toner having stable chargeability for long periods while exerting low-temperature fixability without contamination in the apparatus due to toner scattering and filming over the photoconductor.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The toner of the present disclosure includes a binder resin; a release agent; and two or more inorganic fine particles as external additives. At least one of the inorganic fine particles is silica. When an ultrasonic oscillation is applied to a dispersion including the toner and a dispersant and a rate of the silica releasing from the toner is 20% based on total silica, an application energy of the ultrasonic oscillation is from 8 to 14 kJ, and from 70 to 130 kJ when the rate is 50%.

It is an object for a toner used in recent ultrahigh speed printing systems to have stable chargeability and heat resistant preservability for continuing to produce images having constant image quality even when exposed severe working conditions such as variation of environmental temperature and humidity and continuous production of a large amount of images, and low-temperature fixability for saving energy.

To achieve the object, fine particles such as silica are added to a toner. The state of the fine particles adhering to the surface of a toner largely influences upon its process suitability as well. For example, fine particles feebly adhering or not adhering to a toner tend to transfer onto a photosensitive layer and may cause filming over the photoconductor. However, when the fine particles too strongly adheres to a toner, the fine particles are buried in the toner and spacer effect is not exerted, resulting in blocking problems. When the fine particles are added further to obtain a toner having desired properties, coverage of the fine particles over a toner exceeds a limit of the surface area thereof and the fine particles not adhering thereto and transferring to the photoconductor increase, resulting in production of defective images.

The present inventors found that it is important when an ultrasonic oscillation is applied to a dispersion including the toner and a dispersant and a rate of the silica releasing from the toner is 20% based on total silica, an application energy of the ultrasonic oscillation is from 8 to 14 kJ, and from 70 to 130 kJ when the rate is 50%. This suppresses silica from not adhering to a toner or being buried therein, filming over the photoconductor, a charge from varying due to environment, and a toner from scattering to contaminate the inside of the apparatus.

The present invention suppresses an external additive from releasing from the surface of a toner base particle and being buried therein even when used in ultrahigh speed printing systems for long periods. A toner having stable chargeability for long periods while exerting low-temperature fixability without contamination in the apparatus due to toner scattering and filming over the photoconductor can be provided. The effect of the present invention is not expected when the above range is not satisfied.

As a means of controlling the adhering state of the external additive, a mixer equipped with a jacket to control an inner temperature thereof for preventing the toner from increasing its temperature due to mixing energy is preferably used. The mixer may include a deflector (partition board) having various shapes to control energy applied to the toner and the external additive for the purpose of mixing with application of high energy or uniformly mixing when necessary. To change a history of a load to the external additive, the external additive may be added to the toner completely prior to mixing or gradually added thereto during mixing. As a matter of course, the number of revolutions, rolling speed, time and temperature of the mixer may be changed. A large load first and next a small load, or vice versa may be applied to the toner. Specific examples of the mixer include a locking mixer, a Loedge Mixer, a Nauter Mixer, a Henshel Mixer, etc.

Silica releasing from the toner is measured as follows:

(1) 3.75 g of the toner are dispersed in 50 mL of a dispersion including 0.5% by mass of polyoxyalkylene alkyl ether (NOIGEN ET-165 from DKS Co. Ltd.) in a 110 mL vial;

(2) the dispersion is irradiated with an ultrasonic wave by a ultrasonic homogenizer VCX750, CV33 from Sonics & Materials, Inc. at a frequency of 20 kHz and a power of 80 W for a fixed time, the power and the irradiation time are multiplied to determine an energy amount, and the dispersion is timely cooled so as not to have a temperature not less than 40° C.

(3) the resultant dispersion is subjected to filtration under reduced pressure with a filter paper (qualitative filter paper No. 2, 110 mm from Toyo Roshi Kaisha, Ltd.), washed twice, with ion exchanged water again, filtered to remove released silica, and the toner is dried; and (4) amounts of silica before and after removed are determined by measuring % by mass from an intensity of a calibration curve (or a difference of intensities before and after the external additive is removed) with an X-ray fluorescence analyzer ZSX-100e from Rigaku Corp. to determine an amount of free silica.

$$\text{Free Amount}=(\text{Mass of Silica before Dispersed})-(\text{Mass of Remaining Silica after Dispersed}) \quad \text{[Formula 1]}$$

A free rate (% by mass) of silica is determined by the following formula (2).

$$\text{Free Rate}=[\text{Free Amount}/\text{Total Amount of Silica Added}]\times 100 \quad \text{[Formula 2]}$$

Then, a total amount of silica added is defined as follows.

Amounts of silica of the toner when irradiated with an ultrasonic wave by an ultrasonic homogenizer by the same method as above at irradiation energies of 1,000 and 1,500 kJ are determined by the X-ray fluorescence analyzer to see whether there is no reduction of silica. When there is no reduction of silica, all silica appear free.

The surface of a toner after dried may be observed with a field emission-type scanning electron microscope (FE-SEM) to see all silica releases from the toner. When a change is observed, the irradiation energy is further increased by 500 kJ each and the same procedure is repeated.

From a difference between an amount of silica all released from a toner and an unprocessed toner, total amount of silica added is determined.

After silica is all released, an amount of silica all released from a toner is zero or a specific fixed amount when the base toner includes Si when measured by the X-ray fluorescence analyzer. When a Si amount of the unprocessed toner is measured by the X-ray fluorescence analyzer, the specific fixed amount of Si when the base toner includes Si is added to the amount of Si as an external additive. Therefore, total amount of silica added is determined from a difference between an amount of silica all released from a toner and an unprocessed toner.

In addition, the toner of the present invention preferably has the following property. Namely, in a molecular weight distribution of tetrahydrofuran(THF)-soluble components of the toner, when a random molecular weight M is selected from a molecular weight range of from 300 to 5,000, a difference between the maximum value and the minimum value of a peak intensity defined as follows in a range of M±300 is preferably not greater than 30.

Peak intensity: a relative value when the maximum intensity is 100 in a molecular weight range not greater than 20,000 from a molecular weight distribution curve plotted on a diagram in which a vertical axis is intensity and a horizontal axis is molecular weight through GPC measurement Methods of controlling this include, but are not particularly limited to, a method of substituting an end hydrophilic group of a binder resin with a lipophilic group and a method of accelerating reaction of synthesizing a resin. The method of substituting an end hydrophilic group with a lipophilic group includes, but is not particularly limited to, a method of substituting an end hydroxyl group with a phenoxy acetic acid or a benzoic acid. The method of accelerating reaction of synthesizing a resin include, but is not particularly limited to, a method of reacting at high temperature for a long time and increasing pressure reduction to remove monomers.

In order to improve low-temperature fixability of a toner, it is necessary to control the toner to have lower viscosity at low temperature. The toner preferably has a weight-average molecular weight (Mw) not greater than 10,000 in a molecular weight distribution of THF-soluble components of the toner to have low-temperature fixability. When the weight-average molecular weight (Mw) is greater than 10,000, the toner does not have sufficiently low viscosity and low-temperature fixability thereof may be impaired. Meanwhile, when a binder resin in the toner has lower molecular weight, the toner is easily deformed with heat or mechanical pressure. Low-molecular-weight components increased in the toner contaminate a charging member or the surface of a carrier. The components absorb moisture under high humidity, resulting in deterioration of charge stability of the toner. When an external additive is mixed, low-molecular-weight components in the binder resin at the surface of the toner release therefrom. The resins release at the released point as a base point in a chain reaction and the surface layer of the toner peels off. Pigments inside are exposed and adherence of the external additive to the base toner is thought impaired. The effect of improving heat resistant preservability by mixing the external additive cannot be fully expected.

When a difference between the maximum value and the minimum value of a peak intensity in a range of M±300 is greater than 30, the difference of the intensity mostly means a peak at the low-molecular-weight side. The peak at the low-molecular-weight side in the molecular weight distribution mostly originates from low-molecular-weight components of raw materials such as unreacted residual monomers included in a binder resin and low polymers, i.e., dimers and trimers.

When a difference between the maximum value and the minimum value of a peak intensity is less than 30, i.e., the toner includes low-molecular-weight components less, the low-molecular-weight components in the binder resin at the surface of the toner release therefrom less when an external additive is mixed. This suppresses exposition of the pigments inside of the base toner from impairing adherence of the external additive to the base toner. The external additive adheres to the base toner at a desired strength to increase its effect of improving quality of the toner.

The molecular weight distribution of the THF-soluble components of the toner is measured by GPC as follows.

Gel permeation chromatography (GPC) measuring device: GPC-8220GPC (manufactured by Tosoh Corporation)

Column: TSK-GEL SUPER HZ2000, TSK-GEL SUPER HZ2500, and TSK-GEL SUPER HZ3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner is dissolved in THF (containing a stabilizer, manufactured by Wako Pure Chemical Industries, Ltd.) at 0.15% by mass, followed by filtering through a 0.45 μm filter. The resultant filtrate is used as the sample.

The measurement is performed by injecting a range of from 10 μL to 200 μL of the THF sample solution. As for the measurement of the sample, a molecular weight of the sample is calculated from the relationship between the number of counts and the logarithmic value of the calibration curve prepared from several monodispersed polystyrene standard samples.

As for the polystyrene standard sample for preparing the calibration curve, for example, TSK standard polystyrenes having molecular weights of 37,200, 6,200, 2,500, and 589 (manufactured by Tosoh Corporation) and standard polystyrenes and toluene having molecular weights of 28,400, 20,298, 10,900, 4,782, 1,689, and 1,309 (manufactured by SHOWA DENKO K.K.) can be used. As for a detector, a refractive index (RI) detector is used.

The measurement results of GPC are plotted on a diagram in which a vertical axis is intensity and a horizontal axis is molecular weight, the maximum intensity in a molecular weight range not greater than 20,000 is 100 to correct strength of an entire molecular weight distribution curve. A difference between the maximum value and the minimum value of a peak intensity is determined in a range of M±300.

Figure 2:
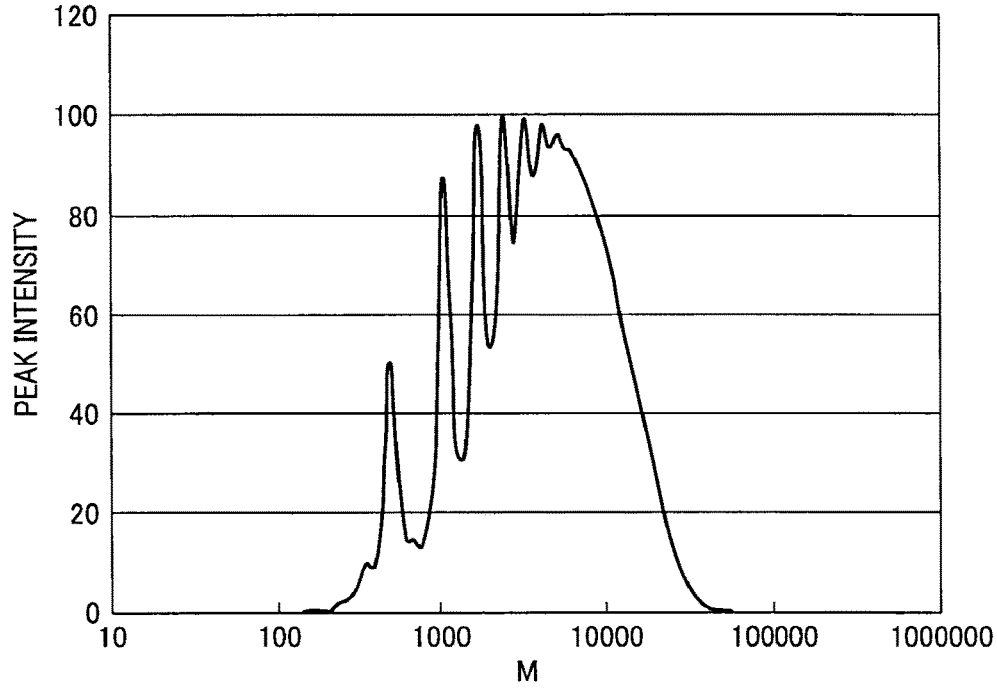
FIG. 2 is a schematic explanatory graph illustrating an embodiment of GPC measurement of a conventional toner.

Selection of a column is important in the GPC measurement of THF-soluble components in a toner according to the present invention. The result is presented in FIG. 1 in the case where the above described columns were used to measure "a toner having a difference of 30 or less between the maximum value and the minimum value among peak intensities defined below (the definition is omitted) in a range of Molecular weight M±300 where Molecular weight M is a molecular weight selected from a range of from 300 to 5,000 in a molecular weight distribution of tetrahydrofuran (THF)-soluble components in the toner as measured by GPC" (Toner A). Meanwhile, the result from a conventional toner that is outside the scope of the present invention (Toner B) is presented in FIG. 2.

Figure 3:
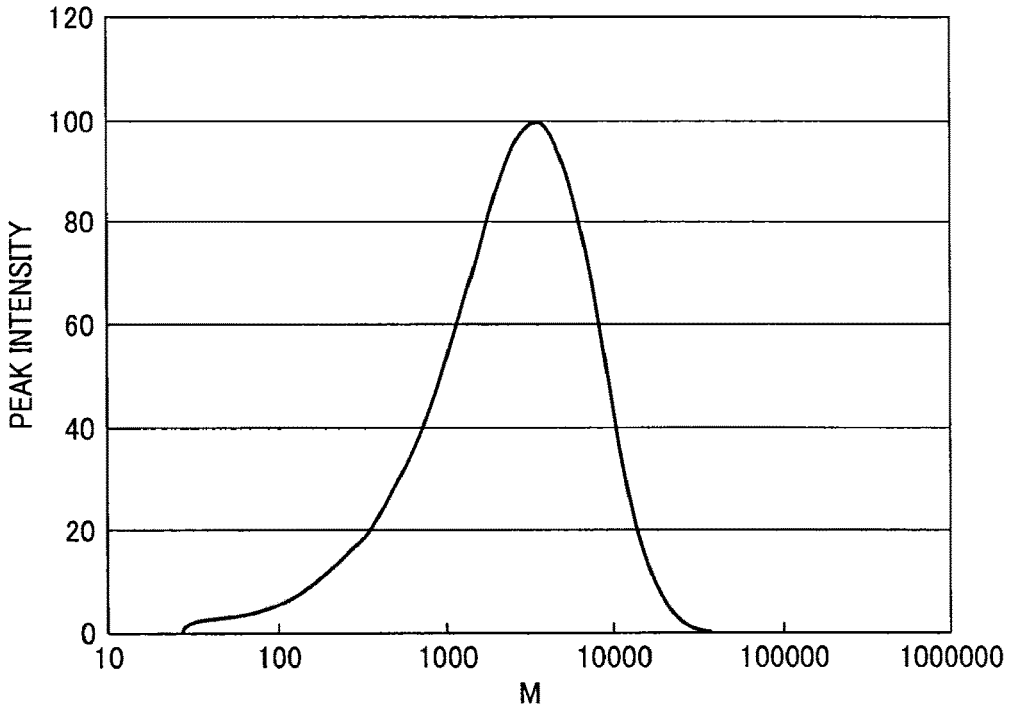
FIG. 3 is a schematic explanatory graph illustrating another embodiment of GPC measurement of the toner of the present invention.
Figure 4:
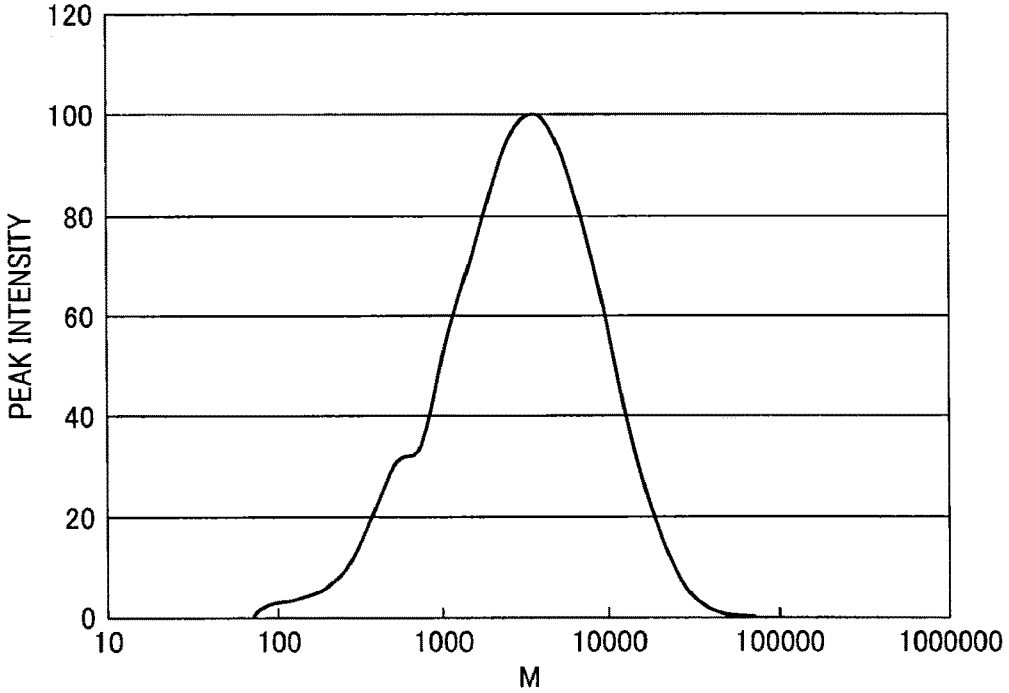
FIG. 4 is a schematic explanatory graph illustrating another embodiment of GPC measurement of a conventional toner.

On the other hand, the results are presented in FIGS. 3 and 4 in the case where three "TSK-GEL SUPER HZM-H" columns connected in series were used for the measurement instead of the above described "Column: TSK-GEL SUPER HZ2000, TSK-GEL SUPER HZ2500, and TSK-GEL SUPER HZ300" (manufactured by Tosoh Corporation). FIG. 3 represents the result from Toner A, and FIG. 4 represents the result from Toner B.

In this case, difference was not found between the Toner A and the conventional Toner B. Thus, selection of a column is important.

The silica in the toner preferably has an average circularity of from 0.4 to 0.8.

The average circularity of the silica (100/SF2) is obtained by the following formula from an image analysis of the primary particles observed with a scanning electron microscope (SEM) after the silica is dispersed in the toner:

$$\text{Circularity } (100/SF2)=4\pi\times(A/I^2)$$

wherein I represents a perimeter of the primary particle of the silica; A represents a projection area of the primary particle of the silica; and SF2 is a shape factor.

An image analysis software LMeye for OPTELICS C130 from Lasertec Corp. was used as follows:

(1) capture an image observed at 5.0 kV by the SEM;
(2) adjust calibration (scale);
(3) perform automatic contrast;
(4) reverse;
(5) perform edge extraction (Sobel);
(6) perform edge extraction (Sobel) again;
(7) digitalize (Discriminant Analysis Mode); and
(8) determine a shape such as circularity, absolute maximum length and diagonal width.

The average circularity of the silica is 50% circularity in a cumulated frequency of equivalent circle diameters of 100 primary particles obtained by the above image analysis.

The silica having an average circularity of from 0.4 to 0.8 is not always spherical. The deformed silica is expected to have higher adherence to the toner. This suppresses the silica from being free from the toner, transferring thereon, being unevenly distributed in concavities and being exposed on the surface of the toner.

A shape and a size of the toner are not particularly limited and may be appropriately selected depending on the intended purpose, but the toner preferably has the following average circularity, the following volume average particle diameter, and the following ratio of the volume-average particle diameter to the number-average particle diameter (volume-average particle diameter/number-average particle diameter).

The average circularity of the toner particles is a value obtained by dividing a perimeter of a circle that has the same projected area as a shape of the toner particle by a perimeter of an actual particle. The average circularity of the toner particles is preferably a range of from 0.950 to 0.980, more preferably a range of from 0.960 to 0.975. The toner particles having the average circularity of less than 0.95 is preferably 15% or less.

When the average circularity of the toner particles is less than 0.950, transferability to be satisfied and an image having high quality and having no dust may not be obtained. In an image forming system employing blade cleaning, the toner particles having an average circularity of more than 0.980 may cause cleaning failure on a photoconductor and on a transfer belt, and may cause fog on an image, such as background fog that is caused by accumulating the residual toner after transfer. The residual toner after transfer remains on the photoconductor when an untransferred image is formed due to paper feeding failure, for example, in cases where an image having high image area rate such as a photographic image is formed. Alternatively, the toner particles having an average circularity of more than 0.980 may pollute, for example, a charging roller to charge a photoconductor in a contact manner, which results in degradation of original charging ability.

The average circularity can be measured by, for example, a flow type particle image analyzer ("FPIA-2100", product of SYSMEX CORPORATION), and analysis can be performed using an analysis software (FPIA-2100, Data Processing Program for FPIA version 00-10). Specifically, a 10% by mass surfactant (alkyl benzene sulfonate, NEOGEN SC-A, product of DKS Co. Ltd.) (a range of from 0.1 mL to 0.5 mL) is added to a 100 mL-glass beaker, and each toner (a range of from 0.1 g to 0.5 g) is added thereto. Then, the mixture is stirred by a micro-spatula, followed by adding 80 mL of ion-exchanged water thereto. The thus-obtained dispersion liquid is subjected to the dispersion treatment for 3 min by an ultrasonic wave disperser (HONDA ELECTRONICS CO., LTD.). A concentration of the dispersion liquid is adjusted to a range of from 5,000 particles/μL to 15,000 particles/μL, and a shape and a distribution of the dispersion liquid are measured using the FPIA-2100.

In the measuring method of the present invention, it is important that a concentration of the dispersion liquid is adjusted to a range of from 5,000 particles/μL to 15,000 particles/μL, in terms of measurement reproducibility of the average circularity. In order to obtain the aforementioned concentration of the dispersion liquid, it is necessary to change conditions of the dispersion liquid (i.e., an amount of the surfactant to be added to the dispersion liquid, and an amount of the toner. Similar to the measurement of the toner particle diameter, a requisite amount of the surfactant is different depending on hydrophobicity of the toner. When the surfactant is excessively added to the dispersion liquid, the resultant toner contains foam, which may cause noise. When the surfactant is slightly added the dispersion liquid, it does not wet the toner, and thus dispersion may be insufficient. An amount of the toner added is different depending on a particle diameter. When the particle diameter is small, an amount of the surfactant may be slightly added to the dispersion liquid. When the particle diameter is large, it is necessary to excessively add the surfactant to the dispersion liquid. When the toner particle diameter is a range of from 3 μm to 10 μm, a concentration of the dispersion liquid can be adjusted to a range of from 5,000 particles/μL to 15,000 particles/μL by adding a range of from 0.1 g to 0.5 g of the surfactant to the dispersion liquid.

A volume-average particle diameter of the toner is not particularly limited and may be appropriately selected depending on the intended purpose, but it is preferably a range of from 3 μm to 10 μm, more preferably a range of from 4 μm to 7 μm. When the volume average particle diameter is less than 3 μm, the resultant two-component developer may cause fusion of the toner particles on the surface of the carrier during stirring for a long term in a developing device, which results in reduction of charging ability of the carrier. When the volume average particle diameter is more than 10 μm, the resultant two-component developer makes it difficult to obtain an image having high resolution and high quality, which may lead to large fluctuation of particle diameters when the toner is supplied and consumed.

A ratio of the volume-average particle diameter to the number-average particle diameter (volume-average particle diameter/number-average particle diameter) is preferably a range of from 1.00 to 1.25, more preferably a range of from 1.00 to 1.15.

The volume-average particle diameter, and the ratio of the volume-average particle diameter to the number-average particle diameter (volume-average particle diameter/number-average particle diameter) can be measured by a particle size determination apparatus ("Multisizer III", product of Beckman Coulter, Inc.) with an aperture of 100 μm, and can be analyzed by an analysis software (Beckman Coulter Multisizer 3 Version 3.51).

Specifically, a 10% by mass surfactant (alkyl benzene sulfonate, NEOGEN SC-A, product of DKS Co. Ltd.) (0.5 mL) is added to a 100 mL-glass beaker, and each of the toners (0.5 g) is added to the beaker. Then, the mixture is stirred by a micro-spatula, followed by adding 80 mL of ion-exchanged water thereto. The obtained dispersion liquid is subjected to the dispersion treatment for 10 min by an ultrasonic wave disperser (W-113MK-II, product of HONDA ELECTRONICS CO., LTD.). The dispersion liquid is measured by the Multisizer III using ISOTON III (product of Beckman Coulter, Inc.) as a measurement solution.

The toner sample dispersing liquid is added dropwise thereto so that a concentration of the toner indicated by the device is 8±2%. In the measurement of the present invention, it is important to adjust the concentration of the toner to 8±2% in terms of measurement repeatability of the particle diameter. There is no accidental error so long as the concentration of the toner falls within the aforementioned range.

TA-60WS and DSC-60 from SHIMADZU CORPORATION can be used to measure the glass transition temperature, the melting points of the crystalline resin and the wax based on the following measurement conditions.

[Measurement Conditions]

Sample container: aluminum sample pan (including lid)

Amount of sample: 5 mg

Reference: aluminum sample pan (alumina 10 mg)

Atmosphere: nitrogen (flow rate 50 mL/min)

Temperature conditions

—1st Heating—

Starting temperature: 20° C.

Heating rate: 10° C./min

End temperature: 150° C.

Retention time: nothing

Cooling rate: 10° C./min

End temperature: 20° C.

—2nd Heating—

Retention time: nothing

Heating rate: 10° C./min

End temperature: 150° C.

A data analyzing software (TA-60, VERSION 1.52, product of SHIMADZU CORPORATION) is used to analyze the measurement results.

The glass transition temperature is measured by specifying a range of ±5° C. as a central focus on a maximum peak point on the lowest temperature side of a DSC differential curve in heating, and a peak temperature is determined using a peak analysis function of the analysis software. Next, the maximum endothermic temperature is determined of the DSC curve using the peak analysis function of the analysis software in the range of the peak temperature ±5° C. This is the glass transition temperature.

The melting point of the crystalline resin is the first endothermic peak temperature seen in the 1st heating and disappeared in the 2nd heating in the DSC curve. Specifically, the first endothermic peak temperature seen in the 1st heating and disappeared in the 2nd heating in the DSC curve is subjected to the peak analysis of the analysis software to determine the maximum endothermic temperature. This is the melting point of the crystalline resin.

The melting point of the wax is an endothermic peak temperature in the 2nd heating in the DSC curve. Specifically, the endothermic peak temperature in the 2nd heating in the DSC curve is subjected to the peak analysis of the analysis software to determine the maximum endothermic temperature. This is the melting point of the wax.

<Toner Components>

The toner of the present invention includes a base toner including at least a binder resin and a release agent, and other components when necessary. Further, two or more inorganic fine particles are added to the base toner as external additives and at least one of them is silica, and other inorganic fine particles are added thereto when necessary.

<<Binder Resin>>

The binder resin is not particularly limited and may be appropriately selected depending on the intended purpose. Examples of the binder resin include a polyester resin, a silicone resin, a styrene acryl resin, a styrene resin, an acryl resin, an epoxy resin, a diene resin, a phenol resin, a terpene resin, a coumarone resin, an amide-imide resin, a butyral resin, a urethane resin, and an ethylene-vinyl acetate resin. These may be used alone or in combination. Among them, a polyester resin and a resin obtained by combining a polyester resin with the aforementioned another binder resin are preferable because the resultant toner is excellent in low-temperature fixability, and has enough flexibility even if the toner particles have lower molecular weight.

—Polyester Resin—

The polyester resin is not particularly limited and may be appropriately selected depending on the intended purpose. Examples of the polyester resin include an unmodified polyester resin and a modified polyester resin. These may be used alone or in combination.

—Unmodified Polyester Resin—

The unmodified polyester resin is not particularly limited and may be appropriately selected depending on the intended purpose. Examples of the unmodified polyester resin include a crystalline polyester resin, and a resin obtained by reacting polyol represented by the following formula (1) and polycarboxylic acid represented by the following formula (2) to form polyester.

$$A\text{-}[OH]_m \quad (1)$$

$$B\text{—}[COOH]_n \quad (2)$$

wherein A represents an alkyl group having 1 to 20 carbon atoms, an alkylene group having 1 to 20 carbon atoms, an aromatic group that may have a substituent, or a heterocyclic aromatic group that may have a substituent; m represents an integer of a range of from 2 to 4; B represents an alkyl group having a range of from 1 to 20 carbon atoms, an alkylene group having 1 to 20 carbon atoms, an aromatic group that may have a substituent, or a heterocyclic aromatic group that may have a substituent; and n represents an integer of a range of from 2 to 4.

The polyol represented by the formula (1) is not particularly limited and may be appropriately selected depending on the intended purpose. Examples of the polyol represented by the formula (1) include ethylene glycol, diethylene glycol, triethylene glycol, 1, 2-propylene glycol, 1, 3-propylene glycol, 1,4-butanediol, neopentyl glycol, 1, 4-butenediol, 1, 5-pentanediol, 1, 6-hexanediol, 1, 4-cyclohexane dimethanol, dipropylene glycol, polyethylene glycol, polypropylene glycol, polytetramethylene glycol, sorbitol, 1, 2, 3, 6-hexane tetrol, 1, 4-sorbitan, pentaerythritol, dipentaerythritol, tripentaerythritol, 1, 2, 4-butanetriol, 1, 2, 5-pentanetriol, glycerol, 2-methylpropane triol, 2-methyl-1, 2, 4-butanetriol, trimethylolethane, trimethylolpropane, 1, 3, 5-trihydroxy methylbenzene, bisphenol A, bisphenol A ethylene oxide adduct, bisphenol A propylene oxide adduct, hydrogenated bisphenol A, hydrogenated bisphenol A ethylene oxide adduct, and hydrogenated bisphenol A propylene oxide adduct. These may be used alone or in combination.

The polycarboxylic acid represented by the formula (2) is not particularly limited and may be appropriately selected depending on the intended purpose. Examples of the polycarboxylic acid represented by the formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1, 2, 4-benzene tricarboxylic acid, 2, 5, 7-naphthalene tricarboxylic acid, 1, 2, 4-naphthalene tricarboxylic acid, 1, 2, 4-butane tricarboxylic acid, 1, 2, 5-hexane tricarboxylic acid, 1, 3-dicarboxyl-2-methyl-2-methylene carboxypropane, 1, 2, 4-cyclohexane tricarboxylic acid, tetra(methylene carboxyl)methane, 1, 2, 7, 8-octanetetra carboxylic acid, pyromellitic acid, empol trimer acid, cyclohexane dicarboxylic acid, cyclohexene dicarboxylic acid, butane tetracarboxylic acid, diphenylsulphone tetracarboxylic acid, and ethylene glycol bis(trimellitic acid). These may be used alone or in combination.

—Modified Polyester Resin—

The modified polyester resin is not particularly limited and may be appropriately selected depending on the intended purpose. Examples of the modified polyester resin include a resin obtained reacting an active hydrogen group-containing compound with polyester that can react with the active hydrogen group-containing compound (hereinafter, referred to as "polyester prepolymer") through the elongation reaction and/or the cross-linking reaction. The elongation reaction and/or the cross-linking reaction can be terminated by a reaction terminator (diethylamine, dibutylamine, butylamine, laurylamine, and a product obtained by blocking monoamine such as a ketimine compound) when necessary.

—Active Hydrogen Group-Containing Compound—

The active hydrogen group-containing compound functions as a crosslinking agent and an elongating agent when the polyester prepolymer undergoes the elongation reaction and the cross-linking reaction in an aqueous medium.

The active hydrogen group-containing compound is not particularly limited and may be appropriately selected depending on the intended purpose, so long as it contains an active hydrogen group. Among them, amines are preferable because the polyester prepolymer is an isocyanate group-containing polyester prepolymer that will be described hereinafter, and thus toner particles having high molecular weight can be obtained.

The active hydrogen group is not particularly limited and may be appropriately selected depending on the intended purpose. Examples of the active hydrogen group include a hydroxyl group (alcoholic hydroxyl group or phenolic hydroxyl group), an amino group, a carboxyl group, and a mercapto group. These may be used alone or in combination.

The amines that are the active hydrogen group-containing compound are not particularly limited and may be appropriately selected depending on the intended purpose. Examples of the amines that are the active hydrogen group-containing compound include diamine, trivalent or higher polyamine, amino alcohol, amino mercaptan, amino acid, and a product obtained by blocking an amino group of the aforementioned amines. Examples of the diamine include aromatic diamine (phenylenediamine, diethyltoluene diamine, and 4, 4'-diaminodiphenylmethane); alicyclic diamine (4, 4'-diamino-3, 3'-dimethyldicyclohexyl methane, diamine cyclohexane, and isophoronediamine); and aliphatic diamine (ethylene diamine, tetramethylene diamine, and hexamethylenediamine). Examples of the trivalent or higher polyamine include diethylenetriamine and triethylene tetramine. Examples of the amino alcohol include ethanol amine and hydroxyethyl aniline. Examples of the amino mercaptan include aminoethyl mercaptan and aminopropyl mercaptan. Examples of the amino acid include amino propionic acid and amino caproic acid. Examples of the product obtained by blocking an amino group of the aforementioned amines include an oxazoline compound and a ketimine compound obtained by reacting any of the amines (e.g., diamine, trivalent or higher polyamine, amino alcohol, amino mercaptan, and amino acid) with ketones (e.g., acetone, methyl ethyl ketone, and methyl isobutyl ketone). These may be used alone or in combination. Among them, diamine, and a mixture of diamine and a small amount of trivalent or higher polyamine are particularly preferable as the amines.

—Polymer that Can React with Active Hydrogen Group-Containing Compound—

A polymer that can react with an active hydrogen group-containing compound is not particularly limited and may be appropriately selected depending on the intended purpose, so long as it contains a group that can react with the active hydrogen group-containing compound. Among them, a polyester resin containing a urea bond-generating group (RMPE) is preferable, and an isocyanate group-containing polyester prepolymer is more preferable, because the resultant toner is excellent in high flowability during melting and transparency; the molecular weight of high molecular components is easy to control; and a dry toner is excellent in oilless low-temperature fixability and releasability.

The isocyanate group-containing polyester prepolymer is not particularly limited and may be appropriately selected depending on the intended purpose. Examples of the isocyanate group-containing polyester prepolymer include a polycondensate obtained by reacting polyol with polycarboxylic acid and a product obtained by reacting the active hydrogen group-containing polyester resin with polyisocyanate.

The polyol is not particularly limited and may be appropriately selected depending on the intended purpose. Examples of the polyol include: diols such as alkylene glycols (e.g., ethylene glycol, 1, 2-propylene glycol, 1, 3-propylene glycol, 1, 4-butanediol, and 1, 6-hexanediol), alkylene ether glycols (e.g., diethylene glycol, triethylene glycol, dipropylene glycol, polyethylene glycol, polypropylene glycol, and polytetramethylene ether glycol), alicyclic diols (e.g., 1, 4-cyclohexane dimethanol and hydrogenated bisphenol A), bisphenols (e.g., bisphenol A, bisphenol F, and bisphenol S), adducts of the bisphenols with alkylene oxides (e.g., ethylene oxide, propylene oxide, and butylene oxide), and adducts of the alicyclic diol with alkylene oxide (e.g., ethylene oxide, propylene oxide, and butylene oxide); trivalent or more polyols such as polyvalent aliphatic alcohols (e.g., glycerin, trimethylolethane, trimethylolpropane, pentaerythritol, and sorbitol), trivalent or more phenols (e.g., phenol novolak, and cresol novolak), and adducts of trivalent or more polyphenol with alkylene oxide; and mixtures of diol and trivalent or more polyol.

These may be used alone or in combination. Among them, the polyol is preferably the diol alone, or a mixture of the diol and a small amount of the trivalent or more polyol.

The diol is preferably alkylene glycol having 2 to 12 carbon atoms and alkylene oxide adducts of bisphenols (e.g., bisphenol A ethylene oxide 2 mole adduct, bisphenol A propylene oxide 2 mole adduct, and bisphenol A propylene oxide 3 mole adduct).

An amount of the polyol in the isocyanate group-containing polyester prepolymer is not particularly limited and may be appropriately selected depending on the intended purpose, but it is preferably a range of from 0.5% by mass to 40% by mass, more preferably a range of from 1% by mass to 30% by mass, still more preferably a range of from 2% by mass to 20% by mass. When the amount of the polyol in the isocyanate group-containing polyester prepolymer is less than 0.5% by mass, the resultant toner may be deteriorated in hot offset resistance, and may have difficulty in achieving both preservability and low-temperature fixability. When the amount of the polyol in the isocyanate group-containing polyester prepolymer is more than 40% by mass, the resultant toner may be deteriorated in low-temperature fixability.

The polycarboxylic acid is not particularly limited and may be appropriately selected depending on the intended purpose. Examples of the polycarboxylic acid include: alkylene dicarboxylic acid (e.g., succinic acid, adipic acid, and sebacic acid); alkenylene dicarboxylic acid (e.g., maleic acid and fumaric acid); aromatic dicarboxylic acid (e.g., terephthalic acid, isophthalic acid, and naphthalene dicarboxylic acid); and trivalent or more polycarboxylic acid (aromatic polycarboxylic acid having 9 to 20 carbon atoms such as trimellitic acid and pyromellitic acid). These may be used alone or in combination.

Among them, the polycarboxylic acid is preferably alkenylene dicarboxylic acid having 4 to 20 carbon atoms or aromatic dicarboxylic acid having 8 to 20 carbon atoms. Note that, an anhydrate of polycarboxylic acid and lower alkyl ester (e.g., methyl ester, ethyl ester, and isopropyl ester) can be used instead of the polycarboxylic acid.

A mixing ratio between the polyol and the polycarboxylic acid is not particularly limited and may be appropriately selected depending on the intended purpose. An equivalent ratio [OH]/[COOH] of the hydroxyl group [OH] in the polyol to the carboxyl group [COOH] in the polycarboxylic acid is preferably a range of from 2/1 to 1/1, more preferably a range of from 1.5/1 to 1/1, still more preferably a range of from 1.3/1 to 1.02/1.

The polyisocyanate is not particularly limited and may be appropriately selected depending on the intended purpose. Examples of the polyisocyanate include: aliphatic polyisocyanate (e.g., tetramethylene diisocyanate, hexamethylene diisocyanate, 2, 6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate); alicyclic polyisocyanate (e.g., isophorone diisocyanate and cyclohexylmethane diisocyanate); aromatic diisocyanate (e.g., tolylene diisocyanate, diphenylmethane diisocyanate, 1, 5-naphthylene diisocyanate, diphenylene-4, 4'-diisocyanate, 4, 4'-diisocyanato-3, 3'-dimethyldiphenyl, 3-methyl diphenylmethane-4, 4'-diisocyanate, and diphenylether-4, 4'-diisocyanate); aromatic aliphatic diisocyanate (e.g., α, α, α', α'-tetramethyl xylylene diisocyanate); isocyanurates (tris-isocyanato alky-isocyanurate and tri isocyanato cycloalkyl-isocyanurate); phenol derivatives of any of the aforementioned compounds; and a product obtained by blocking, for example, oxime or caprolactam. These may be used alone or in combination.

A mixing ratio between the polyisocyanate and the active hydrogen group-containing polyester resin (hydroxyl group-containing polyester resin) is not particularly limited and may be appropriately selected depending on the intended purpose. An equivalent ratio [NCO]/[OH] of the isocyanate group [NCO] in the polyisocyanate to the hydroxyl group [OH] in the hydroxyl group-containing polyester resin is preferably a range of from 5/1 to 1/1, more preferably a range of from 4/1 to 1.2/1, particularly preferably a range of from 3/1 to 1.5/1. When the equivalent ratio [NCO]/[OH] is less than 1/1, the resultant toner may be deteriorated in offset resistance. When the equivalent ratio [NCO]/[OH] is more than 5/1, the resultant toner may be deteriorated in low-temperature fixability.

An amount of the polyisocyanate in the isocyanate group-containing polyester prepolymer is not particularly limited and may be appropriately selected depending on the intended purpose. The amount of the polyisocyanate in the isocyanate group-containing polyester prepolymer is preferably a range of from 0.5% by mass to 40% by mass, more preferably a range of from 1% by mass to 30% by mass, particularly preferably a range of from 2% by mass to 20% by mass. When the amount of the polyisocyanate in the isocyanate group-containing polyester prepolymer is less than 0.5% by mass, the resultant toner may be deteriorated in hot offset resistance, and may have difficulty in achieving both preservability and low-temperature fixability. When the amount of the polyisocyanate in the isocyanate group-containing polyester prepolymer is more than 40% by mass, the resultant toner may be deteriorated in low-temperature fixability.

An average number of the isocyanate group per one molecule of the isocyanate group-containing polyester prepolymer is preferably 1 or more, more preferably a range of from 1.2 to 5, still more preferably a range of from 1.5 to 4. When the average number of the isocyanate group per one molecule of the isocyanate group-containing polyester prepolymer is less than 1, a molecular weight of the polyester resin modified with the urea bond-generating group (RMPE) is low, and thus the resultant toner may be deteriorated in hot offset resistance.

A mixing ratio between the isocyanate group-containing polyester prepolymer and the amines is not particularly limited and may be appropriately selected depending on the intended purpose. A mixing equivalent ratio [NCO]/[NHx] of the isocyanate group [NCO] in the isocyanate group-containing polyester prepolymer to the amino group [NHx] in the amines is preferably a range of from 1/3 to 3/1, more preferably a range of from 1/2 to 2/1, still more preferably a range of from 1/1.5 to 1.5/1. When the mixing equivalent ratio ([NCO]/[NHx]) is less than 1/3, the resultant toner may be deteriorated in low temperature fixing ability. When the mixing equivalent ratio ([NCO]/[NHx]) is more than 3/1, a molecular weight of the urea-modified polyester resin is low, and thus the resultant toner may be deteriorated in hot offset resistance.

—Method for Synthesizing Polymer that Can React with Active Hydrogen Group-Containing Compound—

A method for synthesizing the polymer that can react with an active hydrogen group-containing compound is not particularly limited and may be appropriately selected depending on the intended purpose. In cases where the isocyanate group-containing polyester prepolymer is produced, for example, a method for synthesizing the isocyanate group-containing polyester prepolymer is follows: the polyol and the polycarboxylic acid are heated to a range of from 150° C. to 280° C. in the presence of a known esterification catalyst (e.g., titanium tetrabutoxide or dibutyltin oxide), to obtain a hydroxyl group-containing polyester while reducing pressure in necessary for removing water; and the hydroxyl group-containing polyester is allowed to react with the polyisocyanate at a range of from 40° C. to 140° C., to obtain an isocyanate group-containing polyester prepolymer.

A weight average molecular weight (Mw) of the polymer that can react with an active hydrogen group-containing compound is not particularly limited and may be appropriately selected depending on the intended purpose. The weight average molecular weight of the polymer that can react with an active hydrogen group-containing compound is preferably a range of from 3,000 to 40,000, more preferably a range of from 4,000 to 30,000 in a molecular weight distribution obtained by measuring tetrahydrofuran (THF) soluble matter of the toner by GPC (gel permeation chromatography). When the weight average molecular weight (Mw) of the polymer that can react with an active hydrogen group-containing compound is less than 3,000, the resultant toner may be deteriorated in preservability. When the weight average molecular weight (Mw) of the polymer that can react with an active hydrogen group-containing compound is more than 40,000, the resultant toner may be deteriorated in low temperature fixing ability. Measurement of the weight average molecular weight (Mw) can be performed as follows: First, a column is stabilized in a heat chamber at 40° C. Tetrahydrofuran (THF) as a column solvent is allowed to flow into the column at a velocity of 1 mL/min at 40° C. A tetrahydrofuran sample solution of a resin (a range of from 50 μL to 200 μL) obtained by adjusting a concentration of the sample to a range of from 0.05% by mass to 0.6% by mass is charged into the column, followed by performing measurement.

In the measurement of the molecular weight of the sample, the molecular weight distribution of the sample is determined based on the relationship between the logarithmic value and the number of counts of the calibration curve given by using several monodisperse polystyrene-standard samples. The standard polystyrene samples used for giving the calibration curve are standard polystyrene samples having a molecular weight of $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$ (these products are Pressure Chemical Co. or Tosoh Corporation), and at least about 10 standard polystyrene samples are preferably used. Note that, as the detector, a refractive index (RI) detector can be used.

—Crystalline Resin—

In the toner of the present invention, the binder resin preferably includes a crystalline resin having a melting point of from 50° C. to 65° C. When the melting point of the crystalline resin is less than 50° C., heat resistant preservability and blocking resistance of the toner may deteriorate. When higher than 65° C., low-temperature fixability thereof may deteriorate.

In addition, the toner has sharp meltability. In order to achieve toner properties advantageous for low temperature fixing ability, the toner has a glass transition point of a range of from 40° C. to 70° C. measured in a first temperature rising in measurement of DSC. When the glass transition point in a first temperature rising is defined as "X° C.", the toner does not have a glass transition point falling within a range of from X to X−20° C. in a second temperature rising.

The melting point of the crystalline resin is the peak top temperature seen in the $1^{st}$ heating (from room temperature to 150° C.) and disappeared in the $2^{nd}$ heating (from room temperature to 150° C.) after cooled from 150° C. to room temperature in the DSC curve. The details are as mentioned above.

The crystalline resin is preferably crystalline polyester in terms of low-temperature fixability and charge properties.

The crystalline polyester resin is preferably a crystalline polyester synthesized by reacting a saturated aliphatic diol compound having 2 to 12 carbon atoms as an alcohol component with at least one selected from the group consisting of dicarboxylic acid having a double bond (C=C bond) and 2 to 12 carbon atoms and a saturated dicarboxylic acid having 2 to 12 carbon atoms as an acid component. Examples of the alcohol component used for synthesizing the crystalline polyester resin include 1, 4-butanediol, 1, 6-hexanediol, 1, 8-octanediol, 1, 9-nonanediol, 1, 10-decanediol, 1, 12-dodecanediol, and derivatives thereof. Examples of the acid component used for synthesizing the crystalline polyester resin include fumaric acid, 1, 4-butane dioic acid, 1, 6-hexane dioic acid, 1, 8-octanedioic acid, 1, 10-decanedioic acid, 1, 12-dodecane dioic acid, and derivatives thereof.

Among them, the crystalline polyester resin is preferably formed of at least one aliphatic alcohol components (e.g., 1, 4-butanediol, 1, 6-hexanediol, and 1, 9-nonanediol) and at least one aliphatic dicarboxylic acid components (e.g., fumaric acid, sebacic acid, and 1, 12-dodecane dioic acid) in order to lower a difference between an endothermic peak temperature and an endothermic shoulder temperature of the toner.

As a method for controlling crystallinity and a softening point of the crystalline polyester resin, a non-linear polyester is designed and used, where the non-linear polyester is produced through polycondensation by adding trivalent or higher polyvalent alcohol such as glycerin or trivalent or higher polyvalent carboxylic acid such as trimellitic anhydride to the acid component during producing polyester.

A molecular structure of the crystalline polyester resin can be confirmed by solution-state or solid-state NMR, X-ray diffraction, GC/MS, LC/MS, or IR spectroscopy.

An amount of the crystalline polyester resin in the toner is not particularly limited and may be appropriately selected depending on the intended purpose, but it is preferably a range of from 3% by mass to 15% by mass, more preferably a range of from 5% by mass to 10% by mass. When the amount of the crystalline polyester resin in the toner is 3% by mass or more, it is preferable that the resultant toner be excellent in low temperature fixing ability. When the amount of the crystalline polyester resin in the toner is 15% by mass or less, it is preferable that deterioration of heat storage property of the toner be difficult to cause.

"Being crystalline" in the present invention means that a ratio (softening temperature/maximum peak temperature of heat of fusion) of a softening temperature measured by an elevated flow tester to a maximum peak temperature of heat of fusion (melting point) measured by a differential scanning calorimetry (DSC) is a range of from 0.80 to 1.55, and that a material has property of being steeply softened with heat. A polyester resin having the aforementioned properties is referred to as "crystalline polyester resin".

Note that, a softening temperature of the resin and the toner can be measured by an elevated flow tester (e.g., CFT-500D (product of SHIMADZU CORPORATION)). Specifically, while 1 g of a resin as a sample is heated at the heating rate of 6° C./min, a load of 1.96 MPa is applied by a plunger to extrude the sample from a nozzle having a diameter of 1 mm and a length of 1 mm. An amount of descent of the plunger of the flow tester is plotted versus the temperature. The temperature at which half of the sample is flown out is determined as a softening temperature of the sample.

<<Release Agent>>

The release agent is not particularly limited and may be appropriately selected depending on the intended purpose. Examples of the release agent include: waxes such as a vegetable wax (e.g., carnauba wax, cotton wax, Japan wax, and rice wax), an animal wax (e.g., bees wax and lanolin), a mineral wax (e.g., ozokelite and ceresine), and a petroleum wax (e.g., paraffin, microcrystalline, and petrolatum); waxes other than the above natural waxes such as a synthetic hydrocarbon wax (e.g., Fischer-Tropsch wax and polyethylene wax) and a synthetic wax (e.g., ester wax, ketone, and ether); fatty acid amides such as 1,2-hydroxystearic acid amide, stearic amide, phthalic anhydride imide, and chlorinated hydrocarbons; and a crystalline polymer containing a long-chain alkyl group at a side chain of the polymer such as a homopolymer of polymethacrylic acid n-stearyl or polymethacrylic acid n-lauryl, which are a crystalline polymer having low molecular weight, and a copolymer (e.g., acrylic acid n-stearyl-methacrylic acid ethyl copolymer).

Among them, Fischer-Tropsch wax, paraffin wax, microcrystalline wax, monoester wax, and rice wax are preferable because an amount of an unnecessary volatile organic compounds generated during fixing is low.

As the release agent, a commercially available product can be used. Examples of the microcrystalline wax include: "HI-MIC-1045", "HI-MIC-1070", "HI-MIC-1080", and "HI-MIC-1090" (all products of NIPPON SEIRO CO., LTD.); "BE SQUARE 180 WHITE" and "BE SQUARE 195" (all products of TOYO ADL CORPORATION); "BARECO C-1035" (product of WAX Petrolife); and "CRAYVALLAC WN-1442" (product of Cray Vally).

A melting point of the release agent is not particularly limited and may be appropriately selected depending on the intended purpose, but it is preferably a range of from 60° C. to 100° C., more preferably a range of from 65° C. to 90° C. When the melting point of the release agent is 60° C. or more, the release agent can be prevented from being oozed from the toner particles, and the resultant toner can be excellent in retaining heat resistant storage stability, even if the toner is stored at a high temperature of a range of from 30° C. to 50° C. When the melting point of the release agent is 100° C. or less, it is preferable that the toner can be prevented from causing cold offset during fixing at low temperature.

The release agent is preferably present in a state of dispersing the release agent in the toner base particles. Therefore, the release agent is preferably incompatible with the binder resin. A method for finely dispersing the release agent in the toner base particles is not particularly limited and may be appropriately selected depending on the intended purpose. Examples of the method include a method for dispersing the release agent through shearing force during kneading the materials for producing the toner.

A state of dispersing the release agent can be confirmed by observing thin film slices of the toner particles by a transmission electron microscope (TEM). A diameter of the release agent dispersed is preferably small. However, the diameter of the release agent dispersed is too small, and thus the release agent may not be sufficiently oozed during fixing. Therefore, in cases where the release agent can be confirmed at ×10,000 magnification, the release agent exists in a state of being dispersed. In cases where the release agent cannot be confirmed at ×10,000 magnification, the release agent cannot be sufficiently oozed during fixing, even if it is finely dispersed.

An amount of the release agent in the toner is not particularly limited and may be appropriately selected depending on the intended purpose, but it is preferably a range of from 3% by mass to 15% by mass, more preferably a range of from 5% by mass to 10% by mass. When the amount of the release agent in the toner is less than 3% by mass, it is not preferable that the resultant toner may be deteriorated in hot offset resistance. When the amount of the release agent in the toner is more than 15% by mass, it is not preferable that an amount of the release agent oozed from the toner may be excessive, and thus the resultant toner be deteriorated in heat resistant storage stability.

<<Colorant>>

The toner may include a colorant, and the colorant is not particularly limited and may be appropriately selected from known colorants depending on the intended purpose.

The color of the colorant used for the toner is not particularly limited and may be appropriately selected depending on the intended purpose, but it can be at least one selected from the group consisting of black toner, cyan toner, magenta toner, and yellow toner. The toner for each color can be obtained by appropriately selecting various colorants, but is preferably color toner.

Examples of a colorant for black include: carbon blacks (C.I. Pigment Black 7) such as Furnace black, Lamp black, Acetylene black, and Channel black; metals such as copper, iron (C.I. Pigment Black 11), and titanium oxide; and organic pigments such as aniline black (C.I. Pigment Black 1).

Examples of a pigment for magenta includes: C.I. Pigment Red series (1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, and 269); Pigment Violet 19; and C.I. Vat Red series (1, 2, 10, 13, 15, 23, 29, and 35).

Examples of a pigment for cyan include: C.I. Pigment Blue series (2, 3, 15, 15:1, 15:2, 15:3, 15:4, 15:6, 16, 17, and 60); C.I. Vat Blue 6; C.I. Acid Blue 45; copper phthalocyanine pigment having a phthalocyanine skeleton and 1 to 5 phthalimidemethyl groups substituted thereto; Green 7; and Green 36.

Examples of a pigment for yellow include: C.I. Pigment Yellow series (1, 2, 3, 4, 5, 6, 7, 10, 11, 12, 13, 14, 15, 16, 17, 23, 55, 65, 73, 74, 83, 97, 110, 139, 151, 154, 155, 180, and 185); C.I. Vat Yellow series (1, 3, and 20); and Orange 36.

An amount of the colorant in the toner is preferably a range of from 1% by mass to 15% by mass, more preferably a range of from 3% by mass to 10% by mass. When the amount of the colorant in the toner is less than 1% by mass, the resultant toner may be deteriorated in coloring power. When the amount of the colorant in the toner is more than 15% by mass, the colorant is not sufficiently dispersed in the toner, and thus the resultant toner may be deteriorated in coloring power and electrical property.

The colorant may be used in the form of a master batch in which it is combined with a resin. The resin is not particularly limited, but a binder resin or a resin having the similar structure to the structure of the binder resin is preferable in terms of compatibility of the binder resin.

The master batch can be produced by mixing or kneading the resin and the colorant through high shearing force. In the mixing and kneading, an organic solvent may be added to the colorant and the resin in order to improve the interactions between the colorant and the resin. Moreover, the so-called flashing method is preferable because a wet cake can be used as it is, and is not necessary to dry. The flashing method is a method for removing water or an organic solvent by mixing or kneading an aqueous paste containing water of the colorant with the resin and the organic solvent, to transfer the colorant to the resin side. In the mixing and kneading, a high-shearing disperser such as a three-roll mill can be preferably used.

<<Charge Controlling Agent>>

In order to impair appropriate charging ability to a toner, the toner can contain a charge controlling agent when necessary.

As the charge controlling agent, any of known charge controlling agents can be used. Use of the charge controlling agent containing colored materials may change a color tone of the toner, and thus the charge controlling agent preferably contains colorless materials or materials close to white. Examples of the charge controlling agent include triphenylmethane dyes, molybdic acid chelate pigments, rhodamine dyes, alkoxy amines, quaternary ammonium salts (including fluorine-modified quaternary ammonium salts), alkylamides, phosphorus or phosphorus compounds, tungsten or tungsten compounds, fluorine active agents, metal salts of salicylic acid, and metal salts of salicylic acid derivatives. These may be used alone or in combination.

An amount of the charge controlling agent is determined depending on a method for producing the toner, the method containing the kind of the binder resin and a method for dispersing the binder resin, and is not unambiguously limited. The amount of the charge controlling agent added is preferably a range of from 0.01% by mass to 5% by mass, more preferably a range of from 0.02% by mass to 2% by mass, relative to an amount of the binder resin. The amount of the charge controlling agent of more than 5% by mass may cause considerably high charging ability of the toner, reduction of an effect of the charge controlling agent, and high electrostatic attractive force to a developing roller, which may result in reduction of flowability of the developer and reduction of image density. The amount of the charge controlling agent of less than 0.01% by mass may cause insufficiency of charge rising and an amount of charge, which may influence a toner image.

<<External Additive>>

The external additive is not particularly limited and may be appropriately selected from known external additives. Examples of the external additive include: silica fine particles, hydrophobic silica fine particles, fatty acid metal salts (e.g., zinc stearate and aluminum stearate); metal oxides (e.g., titania, alumina, tin oxide, and antimony oxide) or a hydrophobic product thereof, and fluoropolymer. Among them, hydrophobic silica fine particles, titania fine particles, and hydrophobic titania fine particles are preferable.

Examples of the hydrophobic silica fine particles include: HDK H 2000T, HDK H 2000/4, HDK H 2050EP, HVK 21, and HDK H 1303VP (all products of Clariant (Japan) K.K.); and R972, R974, RX200, RY200, R202, R805, R812, and NX90G (all products of Nippon Aerosil Co., Ltd.).

Examples of the titania fine particles include: P-25 (product of Nippon Aerosil Co., Ltd.); STT-30 and STT-65C-S (both products of Titan Kogyo, Ltd.); TAF-140 (product of Fuji Titanium Industry Co., Ltd.); and MT-150W, MT-500B, MT-600B, and MT-150A (all products of TAYCA CORPORATION).

Examples of the hydrophobic titanium oxide fine particles include: T-805 (product of Nippon Aerosil Co., Ltd.); STT-30A and STT-65S-S (both products of Titan Kogyo, Ltd.); TAF-500T and TAF-1500T (both products of Fuji Titanium Industry Co., Ltd.); T-100S and MT-100T (both products of TAYCA CORPORATION); and IT-S (product of ISHIHARA SANGYO KAISHA, LTD.).

A total coverage ratio of the external additive on the toner base particle is not particularly limited, but it is preferably a range of from 40% to 90%, more preferably a range of from 50% to 80%.

An average particle diameter of the external additive is not particularly limited, but it is preferably a range of from 10 nm to 200 nm, and more preferably a range of from 20 nm to 180 nm.

An amount of silica included in the toner is preferably from 3.5 parts by mass to 4.5 parts by mass per 100 parts by mass of the base toner.

(Method for Producing Toner)

As a method for producing a toner of the present invention and materials of the toner, all known methods and materials can be used without any limitation so long as these methods and materials satisfy the conditions. Examples of the methods include a kneading-pulverization method, and a chemical method in which toner particles are granulated in an aqueous medium.

Examples of the chemical methods include a suspension polymerization method, an emulsion polymerization method, a seed polymerization method, a dispersion polymerization method; a dissolution suspension method; a production method (I); an inverse emulsification method; and an aggregation method. Here, the suspension polymerization method, the emulsion polymerization method, the seed polymerization method, the dispersion polymerization method are methods for producing the toner using a monomer as a starting material. The dissolution suspension method is a method for producing the toner by dissolving a resin or a resin precursor in an organic solvent, to disperse or emulsify the resultant solution in an aqueous medium. The production method (I) includes part of the dissolution suspension method, and is a method for producing the toner by dispersing or emulsifying an oil composition in a resin fine particles-containing aqueous medium, to react an active hydrogen group-containing compound with reactive group-containing prepolymer in the aqueous medium, where the oil composition contains a resin precursor (reactive group-containing prepolymer) containing a functional group that can react with an active hydrogen group. The inverse emulsification method is a method for inverting a phase by adding water to a solution containing an appropriate emulsifying agent and a resin or a resin precursor. The aggregation method is a method in which resin particles obtained by these methods are aggregated in a state of being dispersed in an aqueous medium, to granulate particles having a desired size by heating and melting.

Among them, a toner obtained by the dissolution suspension method, the production method (I), or the aggregation method is preferable, a toner obtained by the production method (I) is more preferable, in terms of granulating property (e.g., controlling particle size distribution and controlling particle shape).

These methods will be described in detail hereinafter.

The kneading and pulverizing method is a method for producing toner base particles by pulverizing and classifying the melt-kneaded toner materials containing at least a colorant, a binder resin, and a release agent.

In the melt-kneading, the toner materials are mixed, and the resultant mixture is charged into a melt-kneader, followed by melt-kneading the resultant mixture. Examples of the melt-kneader include a single-screw or twin-screw continuous kneader, or a batch-type kneader with a roll mill. For example, a KTT type twin screw extruder (product of KOBE STEEL, Co.), a TEM type extruder (product of TOSHIBA MACHINE Co.), a twin screw extruder (product of KCK Engineering Co.), a PCM type twin screw extruder (product of Ikegai Co.), and a co-kneader (product of Buss Co.) are preferably used. The melt-kneading is preferably performed under such appropriate conditions that will not cause the cutting of the molecular chain in the binder resin.

In the pulverizing, the kneaded product obtained in the kneading is pulverized. In this pulverizing, it is preferable that the kneaded product be coarsely pulverized, followed by finely pulverizing the coarsely pulverized product. At this time, a method in which the kneaded product is pulverized by making the kneaded product to crush into an impact plate in the jet stream, a method in which the kneaded product is pulverized by making particles of the kneaded product to crush with each other in the jet stream, and a method in which the kneaded product is pulverized in a narrow gap between a mechanically rotating rotor and a stator are preferably used.

In the classifying, pulverized products obtained in the pulverizing are classified to adjust them to particles having a predetermined particle diameter. The classifying is performed by removing part of fine particles using a cyclone, a decanter, or a centrifugal separator.

After finishing the pulverizing and the classifying, the pulverized products can be classified through centrifugal force under a stream, to produce toner base particles having a predetermined particle diameter.

The dissolution suspension method is a method for producing toner base particles obtained by dispersing or emulsifying an oil phase composition in an aqueous medium, where the oil phase composition is obtained by dispersing or emulsifying, in an organic solvent, a toner composition containing at least binder resin or a resin precursor, a colorant, and a release agent.

As an organic solvent used for dissolving or dispersing the toner composition, a volatile organic solvent having a boiling point of less than 100° C. is preferably used because the subsequent operation of removing the solvent is easy to perform.

Examples of the organic solvent include: an ester solvent or an ester ether solvent such as ethyl acetate, butyl acetate, methoxy butyl acetate, methyl cellosolve acetate, and ethyl cellosolve acetate; an ether solvent such as diethyl ether, tetrahydrofuran, dioxane, ethyl cellosolve, butyl cellosolve, and propylene glycol monomethyl ether; a ketone solvent such as acetone, methyl ethyl ketone, methyl isobutyl ketone, di-n-butyl ketone, and cyclohexanone; an alcohol solvent such as methanol, ethanol, n-propanol, isopropanol, n-butanol, iso butanol, t-butanol, 2-ethylhexylalcohol, and benzyl alcohol; and a mixture solvent obtained in combination with two or more of the aforementioned solvents.

In the dissolution suspension method, an emulsifying agent or a dispersing agent may be used when necessary in order to disperse or emulsify an oil phase composition in an aqueous medium.

As the emulsifying agent or the dispersing agent, known surfactants and known water-soluble polymers can be used. The surfactant is not particularly limited. Examples of the surfactant include an anionic surfactant (e.g., alkyl benzene sulfonic acid and phosphoric acid ester), a cationic surfactant (e.g., quaternary ammonium salt type and amine salt type), an amphoteric surfactant (e.g., carboxylic acid salt type, sulfuric acid ester salt type, sulfonic acid salt type, and phosphoric acid ester salt type), and a nonionic surfactant (e.g., AO-added type and polyvalent alcohol type). These surfactants may be used alone or in combination.

Examples of the water-soluble polymer include a cellulose compound (e.g., methyl cellulose, ethyl cellulose, hydroxyethyl cellulose, ethyl hydroxyethyl cellulose, carboxy methyl cellulose, hydroxypropyl cellulose, and a saponified compound thereof), gelatin, starch, dextrin, Gum arabic, chitin, chitosan, polyvinyl alcohol, polyvinyl pyrrolidone, polyethylene glycol, polyethylene imine, polyacrylamide, an acrylic acid (salt)-containing polymer (e.g., polyacrylic acid sodium, polyacrylic acid potassium, polyacrylic acid ammonium, a product obtained by neutralizing a sodium hydroxide part of polyacrylic acid, and acrylic acid sodium-acrylic acid ester copolymer), a product obtained by neutralizing a sodium hydroxide part of styrene-maleic anhydride copolymer, and a water soluble polyurethane (e.g., a product obtained by reacting polyisocyanate with polyethylene glycol or polycaprolactone diol).

Moreover, the organic solvent and a plasticizing agent can be used together as an auxiliary agent for emulsification or dispersion.

The toner of the present invention is preferably obtained by a method (production method (I)) described as follows: in the dissolution suspension method, an oil phase composition is dispersed or emulsified in a resin fine particles-containing aqueous medium, and the reactive group-containing prepolymer is reacted with the at least one selected from the group consisting of the oil phase composition and an active hydrogen group-containing compound in an aqueous medium to granulate toner base particles, where the oil phase composition contains a binder resin, a binder resin precursor containing a group reactive to an active hydrogen group (reactive group-containing prepolymer), a colorant, and a release agent.

The resin fine particles can be formed by known polymerization method, but are preferably obtained by preparing an aqueous dispersion liquid of resin fine particles. As a method for preparing the aqueous dispersion liquid of resin fine particles, methods (a) to (h) can be used as described below.

(a) A method in which a vinyl monomer as a starting material is polymerized by the suspension polymerization method, the emulsification polymerization method, the seed polymerization method, or the dispersion polymerization method, to thereby directly prepare an aqueous dispersion liquid of resin fine particles.

(b) A method in which a precursor (e.g., a monomer or an oligomer) of a polyaddition resin or a condensation resin (e.g., a polyester resin, a polyurethane resin, or an epoxy resin) or a solvent solution thereof is dispersed in an aqueous medium in the presence of an appropriate dispersant, and then the resultant solution is cured by heating or by the addition of a curing agent, to thereby prepare an aqueous dispersion liquid of resin fine particles.

(c) A method in which an emulsifier is dissolved in a precursor (e.g., a monomer or an oligomer) of a polyaddition resin or a condensation resin (e.g., a polyester resin, a polyurethane resin, or an epoxy resin) or a solvent solution thereof (which is preferably liquid, or may be changed to liquid with heat), and is phase-inverted by the addition of water, to thereby prepare an aqueous dispersion liquid of resin fine particles.

(d) A method in which a resin that has previously been synthesized through polymerization reaction (e.g., addition polymerization, ring-opening polymerization, polyaddition, addition condensation, or condensation polymerization) is pulverized with a pulverizing mill, for example, mechanical rotation-type or jet-type, and is classified for obtaining resin fine particles, which are then dispersed in water in the presence of an appropriate dispersant, to thereby prepare an aqueous dispersion liquid of resin fine particles.

(e) A method in which a resin that has previously been synthesized through polymerization reaction (e.g., addition polymerization, ring-opening polymerization, polyaddition, addition condensation, or condensation polymerization) is dissolved in a solvent to prepare a resin solution, the resin solution is sprayed in the form of mist for obtaining resin fine particles, which are then dispersed in water in the presence of an appropriate dispersant, to prepare an aqueous dispersion liquid of resin fine particles.

(f) A method in which a resin that has previously been synthesized through polymerization reaction (e.g., addition polymerization, ring-opening polymerization, polyaddition, addition condensation, or condensation polymerization) is dissolved in a solvent to prepare a resin solution, and then a poor solvent is added to the resin solution, or the resin solution previously dissolved in a solvent is cooled, to precipitate resin fine particles, the solvent is removed for forming resin fine particles, which are then dispersed in water in the presence of a suitable dispersant, to thereby prepare an aqueous dispersion liquid of resin fine particles.

(g) A method in which a resin that has previously been synthesized through polymerization (e.g., addition polymerization, ring-opening polymerization, polyaddition, addition condensation, or condensation polymerization) is dissolved in a solvent to prepare a resin solution, the resin solution is dispersed in an aqueous medium in the presence of a suitable dispersant, and the solvent is removed by heating or under reduced pressure, to prepare an aqueous dispersion liquid of resin fine particles.

(h) A method in which a resin that has previously been synthesized through polymerization (e.g., addition polymerization, ring-opening polymerization, polyaddition, addition condensation, or condensation polymerization) is dissolved in a solvent to prepare a resin solution, an appropriate emulsifying agent is dissolved in the resin solution, the resultant solution undergoes phase-transfer emulsification by adding water thereto, to prepare an aqueous dispersion liquid of resin fine particles.

A volume-average particle diameter of the resin fine particles is preferably 10 nm to 300 nm, more preferably 30 nm to 120 nm. When the volume average particle diameter of the resin fine particles is less than 10 nm or more than 300 nm, it is not preferable that the particle size distribution of the toner may be deteriorated.

A solid content concentration of the oil phase is preferably a range of from about 40% to about 80%. When the solid content concentration of the oil phase is too high, the toner materials are difficult to dissolve or disperse, a viscosity of the toner is high, and thus the resultant toner has difficulty in use. When the solid content concentration of the oil phase is too low, productivity of the toner may be deteriorated.

A toner composition other than the binder resin such as the colorant and the release agent, and a master batch of the above materials are each individually dissolved or dispersed in an organic solvent, to be mixed with a binder resin dissolving solution or a binder resin dispersing solution.

As the aqueous medium, water can be used alone, or a solvent capable of being mixed with water can be used in combination with the water. Examples of the solvent capable of being mixed with water include alcohols (e.g., methanol, isopropanol, and ethylene glycol), dimethyl formamide, tetrahydrofuran, cellosolves (e.g., methyl cellosolve), and lower ketones (e.g., acetone and methyl ethyl ketone).

When a toner includes the active hydrogen group-containing compound too much, the particle diameter distribution thereof may deteriorate and unevenness of the surface potential among the toner particles may be large. Therefore, a toner needs including the active hydrogen group-containing compound in a proper amount.

A method for dispersing or emulsifying the oil phase in the aqueous medium is not particularly limited. Examples of the method for dispersing or emulsifying the oil phase in the aqueous medium include known equipment such as a low-speed shearing disperser, a high-speed shearing disperser, a friction disperser, a high-pressure jetting disperser, and an ultrasonic disperser. Among them, a high-speed shearing disperser is preferable in terms of making the particle size smaller. When a high-speed shearing disperser is used, a rotating speed of the high-speed shearing disperser is not particularly limited, but it is preferably a range of from 1,000 rpm to 30,000 rpm, more preferably a range of from 5,000 rpm to 20,000 rpm. A temperature at which the dispersion is performed using the high-speed shearing disperser is generally a range of from 0° C. to 150° C. (under pressurization), preferably a range of from 20° C. to 80° C.

A method for removing the organic solvent from the obtained emulsified dispersion is not particularly limited and known methods for removing the organic solvent can be used. A method in which the temperature is gradually increased under normal pressure or reduced pressure with stirring, to evaporate and remove the organic solvent in droplets can be employed.

As a method for washing and drying toner base particles dispersed in an aqueous medium, known techniques can be used. That is, solid-liquid separation is performed by a centrifugal separator or a filter press, the thus-obtained toner cake is re-dispersed in a deionized-water of normal temperature through about 40° C., and then a pH of the dispersed material is adjusted with an acid or an alkaline when necessary. Then, a step of the solid-liquid separation is repeated several times to remove impurity products or the surfactant. Then, the thus-obtained product is dried with a flash dryer, a circulation dryer, a vacuum dryer, and a vibration flash dryer, to obtain toner powders. At this time, a component of toner fine particles may be removed through centrifugation. A desired particle size distribution can be obtained using a known classifying device after drying, when necessary.

The aggregation method is a method for producing toner base particles by mixing a resin fine particles dispersion liquid containing a binder resin, a colorant particles dispersion liquid, and a release agent particles dispersion liquid (when necessary) for aggregation. The resin fine particles dispersion liquid can be obtained through known methods such as the emulsification polymerization, the seed polymerization, and the phase-inversion. The colorant particles dispersion liquid and the release agent particles dispersion liquid can be obtained by dispersing a colorant or a release agent in an aqueous medium by a known wet dispersion method.

In order to control the aggregated state, it is preferable that heat be applied thereto, that a metal salt be added thereto, and that a pH of the toner be adjusted.

A metal forming the metal salt is not particularly limited. Examples of the metal forming the metal salt include a monovalent metal forming sodium salts and potassium salts; a divalent metal forming calcium salts and magnesium salts; and a trivalent metal forming aluminum salts.

Examples of an anion forming the metal salt include a chloride ion, a bromide ion, an iodide ion, a carbonate ion, and a sulfate ion. Among them, magnesium chloride, aluminum chloride, a complex thereof, and a multimer thereof are preferable.

The heating is preferably performed in the course of the aggregation or after the aggregation, which can promote fusion between the resin fine particles in terms of uniformity of the resultant base particles. Moreover, it is possible to control the shape of the toner by the heating. The base particles become closer to a spherical shape by further applying heat thereto.

A method for washing and drying the toner base particles dispersed in the aqueous medium can be performed by the aforementioned methods.

Inorganic fine particles such as silica are added to the toner base particles and are mixed therewith.

A mixer used for mixing an additive agent is preferably adjustable in its inner temperature by a jacket or the like provided to the mixer such that a toner is not heated so much to denature the binder resin. Note that, the additive agent may be added gradually or in the course of the mixing, in order to change the history of the load applied to the external additive. In this case, the number of rotations, a rotation speed, a mixing time, and a temperature of the mixer may be changed. Also, a large load may be initially applied to the additive agent, and next a relatively small load may be applied thereto, or vice versa. As a mixing equipment, a V-type Mixer, a Rocking Mixer, a Loedige Mixer, a Nauta Mixer, and a Henschel Mixer can be used. Next, the resultant mixture may be passed through a sieve of 250 mesh or more, and thus coarse particles and aggregation particles are removed, to obtain the toner.

(Developer)

A developer of the present invention contains at least the toner, further contains other components appropriately selected such as a carrier. The developer may be a one-component developer or a two-component developer. However, the two-component developer is preferably used for recent high-speed printers responding to improved information processing speed, in terms of improvement of lifetime of the printer.

When the toner is used for the one-component developer, the toner particles is prevented from aggregation due to stress applied from the developing unit over time, filming on the developing roller, and fusion on a layer-thickness regulating member such as a blade to thin a toner layer. Therefore, stability of image density and transfer property are favorably maintained, and thus an image having good and stable quality can be obtained.

When the toner is used for the two-component developer, aggregation of the toner particles due to stress applied from the developing unit does not easily occur over time, so that formation of an abnormal image is suppressed, and thus stability of image density and transfer property can be favorably maintained, which leads to excellent and stable image quality.

<Carrier>

The carrier is not particularly limited and may be appropriately selected depending on the intended purpose, but it preferably contains core particles and a resin layer (coating layer) coating the core particles.

<<Core Particles>>

The core particles are not particularly limited and may be appropriately selected depending on the intended purpose, so long as it has magnetism. Examples of the core particles include resin particles obtained by dispersing a magnetic material such as a ferromagnetic metal (e.g., iron and cobalt); and iron oxide (e.g., magnetite, hematite, and ferrite) in a resin. Among them, Mn ferrite, Mn—Mg ferrite, and Mn—Mg—Sr ferrite are preferable because they are environmental friendly.

—Weight Average Particle Diameter (Dw) of Core Particles—

A weight average particle diameter (Dw) of the core particles is a particle diameter at an integrated value of 50% in the particle size distribution obtained by a laser diffraction scattering method. A weight average particle diameter (Dw) of the core particles is not particularly limited and may be appropriately selected depending on the intended purpose, it is preferably a range of from 10 μm to 80 μm, more preferably a range of from 20 μm to 65 μm.

A weight average particle diameter (Dw) of the core particles can be calculated from the following Formula (I) based on the particle size distribution of the particles (relation between number frequency and particle diameter) measured on a number basis with micro track particle size analyzer HRA9320-X100 (product of Honeywell Co.). Here, each channel is a length for dividing the range of the particle diameters in the particle size distribution diagram into a unit width for measurement. A lower limit value of particle diameter stored in each channel is used as a representative particle diameter.

$$Dw=\{1/\Sigma(nD_3)\}\times\{\Sigma(nD_4)\} \quad (I)$$

wherein D represents a representative particle diameter (μm) of core particles present in each channel: and n represents the total number of core particles present in each channel.

[Measurement Conditions]

[1] Particle diameter range: a range of from 8 μm to 100 μm

[2] Channel length (channel width): 2 μm

[3] Number of channels: 46

[4] Refraction index: 2.42

<<Coating Layer>>

The coating layer preferably contains at least a resin, further contains other components such as a filler.

—Resin—

A resin used for forming a coating layer of a carrier is not particularly limited and may be appropriately selected depending on the intended purpose. Examples of the resin include: a crosslinkable copolymer product including, for example, polyolefin (e.g., polyethylene and polypropylene) or a modified product thereof, a polystyrene-acryl resin, acrylonitrile, vinyl acetate, vinyl alcohol, vinyl chloride, vinyl carbazole, and vinyl ether; a silicone resin containing an organosiloxane bond or a modified product thereof (e.g., a modified product of an alkyd resin, a polyester resin, an epoxy resin, polyurethane, and polyimide); polyamide; polyester; polyurethane; polycarbonate; a urea resin; a melamine resin; a benzoguanamine resin; an epoxy resin; an ionomer resin; a polyimide resin; and a derivative thereof. These may be used alone or in combination. Among them, a silicone resin is preferable.

The silicone resin is not particularly limited and may be appropriately selected from the generally-known silicone resins depending on the intended purpose. Examples of the silicone resin a straight silicone resin containing only an organosiloxane bond, and a silicone resin modified with alkyd, polyester, epoxy, acryl, and urethane.

Examples of the straight silicone resin include: KR271, KR272, KR282, KR252, KR255, and KR152 (all products of Shin-Etsu Chemical Co., Ltd.); and SR2400, SR2405, SR2406 (all products of Dow Corning Toray Co., Ltd.).

Specific examples of the above modified silicone resin include an epoxy-modified product (ES-1001N), an acryl-modified silicone (KR-5208), a polyester-modified product (KR-5203), an alkyd-modified product (KR-206), a urethane-modified product (KR-305) (all products of Shin-Etsu Chemical Co., Ltd.), and an epoxy-modified product (SR2115) and an alkyd-modified product (SR2110) (all products of Dow Corning Toray Co., Ltd.).

Note that, the silicone resin can be used alone, but can be used in combination of a crosslinkage reactive component and a charge amount adjusting component.

Examples of the crosslinkage reactive component include a silane coupling agent. Examples of the silane coupling agent include methyl trimethoxysilane, methyl triethoxysilane, octyltrimethoxysilane, and an aminosilane coupling agent.

—Filler—

The filler is not particularly limited and may be appropriately selected depending on the intended purpose. Examples of the filler include an electroconductive filler and a non-electroconductive filler. These may be used alone or in combination. Among them, the filler preferably contains the coating layer containing the electroconductive filler and the non-electroconductive filler.

The electroconductive filler means a filler having a powder electric specific resistance value of 100 Ω·cm or less.

The non-electroconductive filler means a filler having a powder electric specific resistance value of more than 100 Ω·cm.

Measurement of a powder electric specific resistance value of the filler can be performed using a powder resistance measurement system (MCP-PD51, product of Dai a Instruments) and a resistivity meter (4-terminal and 4-probe type, Loresta-GP, product of Mitsubishi Chemical Analytech Co.) under the following conditions: sample; 1.0 g, electrode interval; 3 mm, radius of sample; 10.0 mm, load; 20 kN.

—Electroconductive Filler—

The electroconductive filler is not particularly limited and may be appropriately selected depending on the intended purpose. Examples of the electroconductive filler include: an electroconductive filler in which a layer of tin dioxide or indium oxide is formed on a base such as aluminum oxide, titanium oxide, zinc oxide, barium sulfate, and silicon oxide; and an electroconductive filler formed by using carbon black. Among them, an electroconductive filler containing aluminum oxide, titanium oxide, or barium sulfate is preferable.

—Non-Electroconductive Filler—

The non-electroconductive filler is not particularly limited and may be appropriately selected depending on the intended purpose. Examples of the non-electroconductive filler include a non-electroconductive filler made using, for example, aluminum oxide, titanium oxide, barium sulfate, zinc oxide, silicon dioxide, or zirconium oxide. Among them, a non-electroconductive filler containing aluminum oxide, titanium oxide, or barium sulfate is preferable.

<<Method for Producing Carrier>>

A method for producing the carrier is not particularly limited and may be appropriately selected depending on the intended purpose. A method in which the surface of the core particle is coated with a coating layer forming solution containing the resin to form a carrier is preferable. Note that, when the surface of the core particle is coated with the coating layer forming solution, the resin contained in the coating layer may undergo condensation. Alternatively, after the surface of the core particle is coated with the coating layer forming solution, the resin contained in the coating layer may undergo condensation. A method for condensing the resin is not particularly limited and may be appropriately selected depending on the intended purpose. Examples of the method for condensing the resin include a method for condensing the resin by applying heat or light to the coating layer forming solution.

—Weight Average Particle Diameter (Dw) of Carrier—

A weight average particle diameter (Dw) of the carrier is a particle diameter of the core particles at an integrated value of 50% in the particle size distribution obtained by a laser diffraction scattering method. A weight average particle diameter (Dw) of the carrier is not particularly limited and may be appropriately selected depending on the intended purpose, it is preferably a range of from 10 μm to 80 μm, more preferably a range of from 20 μm to 65 μm.

A weight average particle diameter (Dw) of the carrier can be calculated from the following Formula (II) based on the particle size distribution of the particles (relation between number frequency and particle diameter) measured on a number basis with micro track particle size analyzer HRA9320-X100 (product of Honeywell Co.). Here, each channel is a length for dividing the range of the particle diameters in the particle size distribution diagram into a unit width for measurement. A lower limit value of particle diameter stored in each channel is used as a representative particle diameter.

$$Dw=\{1/\Sigma(nD3)\}\times\{\Sigma(nD4)\} \quad \text{(II)}$$

wherein D represents a representative particle diameter (μm) of a carrier present in each channel, and n represents the total number of particles present in each channel.

[Measurement Conditions]

[1] Particle diameter range: a range of from 8 μm to 100 μm

[2] Channel length (channel width): 2 μm

[3] Number of channels: 46

[4] Refraction index: 2.42

When the developer is a two-component developer, a ratio of the toner to the carrier in the two-component developer is a range of from 2.0% by mass to 12.0% by mass, more preferably a range of from 2.5% by mass to 10.0% by mass, relative to an amount of the carrier.

(Toner Housing Unit)

A toner housing unit of the present invention stores a toner in a unit having a function of storing the toner. Here, aspects of the toner housing unit are, for example, a toner stored container, a developing device, and a process cartridge.

The toner stored container is a container storing a toner.

The developing device includes a unit storing a toner, and performs development.

The process cartridge integrally includes an image bearer and a developing unit, stores a toner, and is detachable to an image forming apparatus. The process cartridge may further include at least one selected from the group consisting of a charging unit, an exposing unit, and a cleaning unit.

(Image Forming Method and Image Forming Apparatus)

An image forming method used in the present invention includes: at least an electrostatic latent image forming step (charging step and exposing step), a developing step, a transfer step, and a fixing step; and further includes: other steps appropriately selected depending on the intended purpose, such as a charge-eliminating step, a cleaning step, a recycling step, and a controlling step.

An image forming apparatus of the present invention includes: at least an electrostatic latent image bearer; a charging unit to charge the surface of the electrostatic latent image bearer; an exposing unit to expose the charged surface of the electrostatic latent image bearer to form an electrostatic latent image; a developing unit to sequentially develop the electrostatic latent images with a plurality of color toners to form a visible image; a transfer unit to transfer the visible image to form a transferred image on a recording medium; and a fixing unit to fix the transferred image on the recording medium. The image forming apparatus of the present invention includes other units appropriately selected depending on the intended purpose, such as a charge-eliminating unit, a cleaning unit, a recycling unit, and a controlling unit.

The electrostatic latent image bearer in the image forming apparatus of the present invention preferably has a linear speed not less than 300 mm/sec to be capable of forming images at higher speed.

—Electrostatic Latent Image Forming Step and Electrostatic Latent Image Forming Unit—

The electrostatic latent image forming step is a step of forming an electrostatic latent image on an electrostatic latent image bearer.

A material, a shape, a structure, and a size of the electrostatic latent image bearer (may be referred to as "electrophotographic photoconductor" and "photoconductor") are not particularly limited and may be appropriately selected from known electrostatic latent image bearers. Examples of the shape of the electrostatic latent image bearer include a drum shape. Examples of the material of the electrostatic latent image bearer include an inorganic photoconductor (e.g., amorphous silicon and selenium), and an organic photoconductor (OPC) (e.g., polysilane and phthalopolymethine). Among them, an organic photoconductor (OPC) is preferable because an image with higher fineness can be obtained.

The electrostatic latent image can be formed by an electrostatic latent image forming unit, where the electrostatic latent image forming unit uniformly charges the surface of the electrostatic latent image bearer, followed by imagewise exposing.

The electrostatic latent image forming unit includes: at least a charging unit (charging device) to uniformly charge the surface of the electrostatic latent image bearer; and an exposing unit (exposing device) to imagewise expose the surface of the electrostatic latent image bearer.

For example, the charging can be performed by applying a voltage to a surface of the electrostatic latent image bearer using the charging device.

The charging device is not particularly limited and may be appropriately selected depending on the intended purpose. Examples of the charging device include known contact charging devices, equipped with an electroconductive or semiconductive roller, brush, film, or rubber blade, and a non-contact charging device utilizing corona discharge, such as corotron and scorotron.

It is preferred that the charging device be provided in contact with the electrostatic latent image bearer, or in non-contact with the electrostatic latent image bearer, and the surface of the electrostatic latent image bearer be charged by applying superimposed AC voltage and DC voltage.

Moreover, it is preferred that the charging device be charging roller disposed adjacent to the electrostatic latent image bearer in a non-contact manner via a gap tape, and configured to charge the surface of the electrostatic latent image bearer by applying superimposed AC voltage and DC voltage to the charging roller.

The exposure can be performed by imagewise exposing the surface of the electrostatic latent image bearer using the exposing device.

The exposing device is not particularly limited and may be appropriately selected depending on the intended purpose, so long as it can imagewise expose the surface of the electrostatic latent image bearer charged by the charging device. Examples of the exposing device include various exposure devices, such as a copy optical system, a rod lens array system, a laser optical system, and a crystal shutter optical system.

Note that, in the present invention, a back side system may be employed, where the back side system means that imagewise exposure is performed from the back side of the electrostatic latent image bearer.

—Developing Step and Developing Unit—

The developing step is a step of developing the electrostatic latent image using the toner, to form a visible image.

The visible image can be formed by the developing unit, for example, by developing the electrostatic latent image using the toner.

The developing unit suitably contains at least, for example, a developing device that stores the toner, and configured to apply the toner to the electrostatic latent image in a contact or non-contact manner. A developing device including a container with the toner is more preferable.

The developing unit may be a developing unit for a single color, or a developing unit for multicolor. Examples of the developing device include a developing device containing a stirring device configured to stir the toner by friction to be charged and a rotatable magnetic-roller.

In the developing unit, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed near the electrostatic latent image developing member (photoconductor), and thus some of the toner particles that form the magnetic brushes formed on the surface of the magnet roller are transferred onto the surface of the electrostatic latent image developing member (photoconductor) by the action of electrically attractive force. As a result, the electrostatic latent image is developed with the toner particles to form a visible image on the surface of the electrostatic latent image developing member (photoconductor).

—Transfer Step and Transfer Unit—

The transfer step is a step of transferring the visible image onto a recording medium. The transfer step is preferably an aspect where an intermediate transfer member is used to primarily transfer a visible image onto the intermediate transfer member, to secondarily transfer the thus-transferred visible image onto the recording medium. The transfer step is more preferably an aspect including a primary transfer step and a secondary transfer step, where the primary transfer step is a step of transferring a visible image onto an intermediate transfer member using two or more toners, preferably toners of full colors, to form a composite transfer image, and the secondary transfer step is a step of transferring the composite transfer image onto a recording medium.

The transferring can be performed by the transfer unit, for example, by charging the visible image on the electrostatic latent image bearer (photoconductor) using a transfer charger. Examples of the transfer unit include an aspect including a primary transfer unit and a secondary transfer unit, where the primary transfer unit is configured to transfer a visible image onto an intermediate transfer member to form a composite transfer image, and the secondary transfer unit is configured to transfer the composite transfer image on a recording medium.

Note that, the intermediate transfer member is not particularly limited and may be appropriately selected from known transfer members depending on the intended purpose. Examples of the intermediate transfer member suitably include a transfer belt.

The transfer unit (the primary transfer unit and the secondary transfer unit) preferably includes at least a transfer device configured to charge the visible images formed on the electrostatic latent image developing member (photoconductor) onto the recording medium to be transferred onto the recording medium. The number of the transfer unit may be one, or two or more.

Examples of the transfer device include a corona transfer device employing corona discharge, a transfer belt, a transfer roller, a pressing transfer roller, and an adhesive transferring device.

The recording medium is not particularly limited and may be appropriately selected from known recording medium (recording paper).

—Fixing Step and Fixing Unit—

The fixing step is a step of fixing a visible image transferred on recording medium by a fixing device. The fixing step may be performed every time when an image of each color toner is transferred onto the recording medium, or the fixing step may be performed at one time in a state that images of color toners are superposed.

The fixing device is not particularly limited and may be appropriately selected depending on the intended purpose, but it is preferably a known heating-pressurizing unit. Examples of the heating-pressurizing unit include a combination of a heat roller and a press roller, and a combination of a heat roller, a press roller, and an endless belt.

The fixing device includes: a heating member containing a heat generating element; a film configured to contact with the heating member; and a pressurizing member configured to be pressed against the heating member via the film. The fixing device is preferably a unit configured to pass recording medium on which an unfixed image is formed between the film and the pressurizing member, to fix the recording medium with heat. The heating-pressurizing unit usually performs heating preferably at a range of from 80° C. through 200° C.

Note that, in the present invention, known photofixing devices may be used instead of or in addition to the fixing step and the fixing unit depending on the intended purpose.

—Other Steps and Other Units—

The charge-eliminating step is a step of applying a charge-eliminating bias to the electrostatic latent image bearer, to eliminate charge, and can be performed by a charge-eliminating unit.

The charge-eliminating unit is not particularly limited and may be appropriately selected from known charge-eliminating devices depending on the intended purpose, so long as it apply a charge-eliminating bias to the electrostatic latent image bearer. Examples of the charge-eliminating unit include a charge-eliminating lamp.

The cleaning step is not particularly limited so long as it can remove the toner remaining on the electrostatic latent image bearer, and can be suitably performed by a cleaning unit.

The cleaning step is not particularly limited and may be appropriately selected from known cleaners so long as it can remove the toner reaming on the electrostatic latent image bearer. Examples of the cleaning unit include a magnetic brush cleaner, an electrostatic brush cleaner, a magnetic roller cleaner, a blade cleaner, a brush cleaner, and a web cleaner.

The recycling step is a step of recycling the toner removed by the cleaning step to the developing unit, and can be suitably performed by a recycling unit. The recycling unit is not particularly limited. Examples of the recycling unit include known conveying units.

The controlling step is a step of control each of the above steps, and each of the steps can be suitably performed by a controlling unit.

The controlling unit is not particularly limited and may be appropriately selected depending on the intended purpose, so long as it can control each of the above units. Examples of the controlling unit include devices such as a sequencer and a computer.

Figure 5:
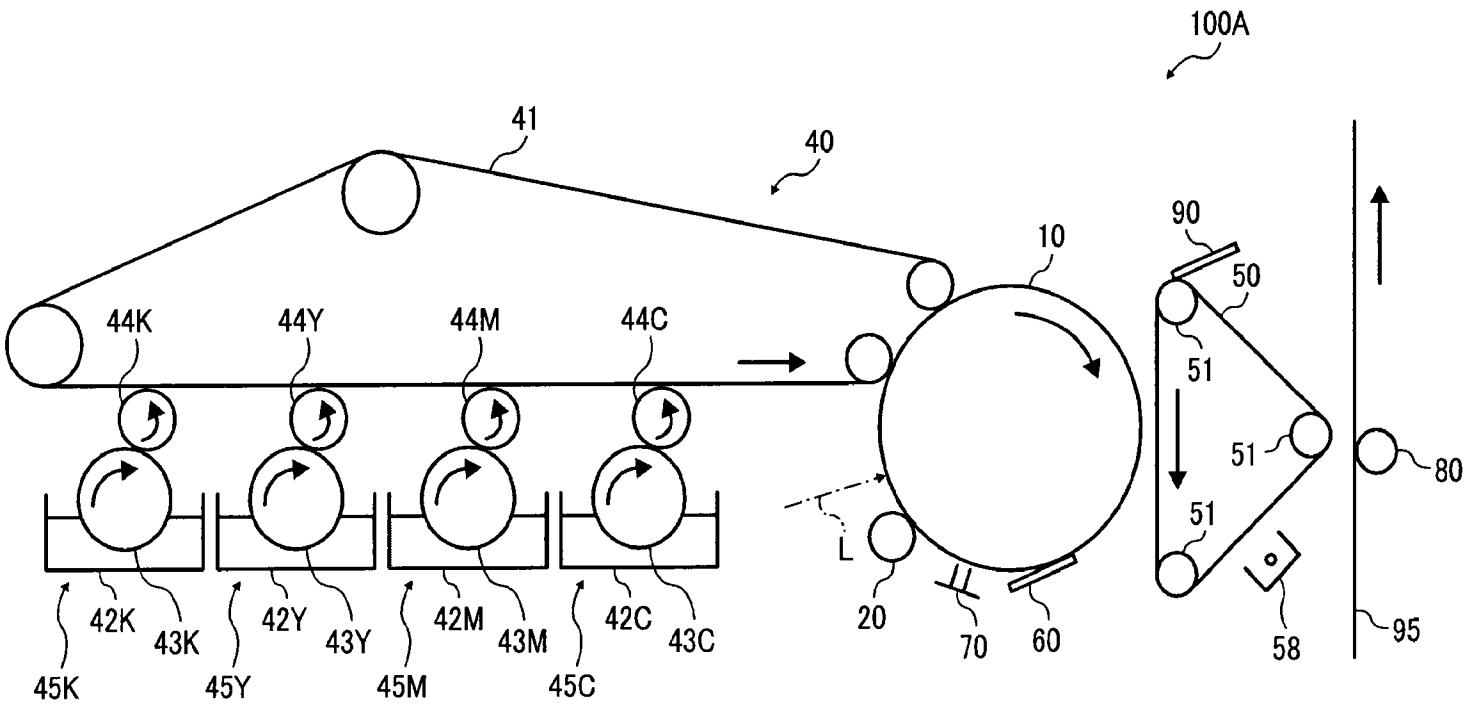
FIG. 5 is a schematic explanatory diagram illustrating an embodiment of the image forming apparatus of the present invention.

FIG. 5 illustrates one example of an image forming apparatus of the present invention. An image forming apparatus 100A includes a photoconductor drum 10, a charging roller 20, an exposing device, a developing device 40, an intermediate transfer belt 50, a cleaning device 60 containing a cleaning blade, and a charge-eliminating lamp 70.

The intermediate transfer belt 50, which is an endless belt, is stretched around three rollers 51 disposed in the belt, and is movable in a direction indicated by the arrow of the figures. A part of three rollers 51 also functions as a transfer bias roller that can apply a transfer bias (primary transfer bias) to the intermediate transfer belt 50. Near the intermediate transfer belt 50, a cleaning device 90 including a cleaning blade is disposed. Also, a transfer roller 80 that can apply a transfer bias (secondary transfer bias) onto a transfer paper 95 configured to transfer a toner image is disposed facing the intermediate transfer belt 50. Around the intermediate transfer belt 50, a corona charging device 58 configured to apply a charge to the toner image transferred on the intermediate transfer belt 50 is disposed between a contact portion of the photoconductor drum 10 with the intermediate transfer belt 50 and a contact portion of the intermediate transfer belt 50 with the transfer paper 95 in a rotational direction of the intermediate transfer belt 50.

The developing device 40 is composed of a developing belt 41; and a black developing unit 45K, a yellow developing unit 45Y, a magenta developing unit 45M, and a cyan developing unit 45C, which are disposed around the developing belt 41. A developing unit 45 for each color includes a developer storage unit 42, a developer supplying roller 43, and a developing roller 44 (developer bearing member). Moreover, the developing belt 41, which is an endless belt, is stretched around a plurality of rollers, and is movable in a direction indicated by the arrow of the figures. A part of the developing belt 41 contacts with the photoconductor drum 10.

Next, a method for forming an image using the image forming apparatus 100A will be described hereinafter. The surface of the photoconductor drum 10 is uniformly charged by the charging roller 20. Then, the exposing device (not illustrated) exposes the surface of the photoconductor drum 10 to light, to form an electrostatic latent image. Next, the electrostatic latent image formed on the photoconductor drum 10 is developed using the toner supplied from a developer from the developing device 40, to form a toner image. The toner image formed on the photoconductor drum 10 is transferred (primarily transferred) onto the intermediate transfer belt 50, and is further transferred (secondary transferring) onto the transfer paper 95 by a transfer bias applied from the transfer roller 80. Meanwhile, a residual toner remaining on the surface of the photoconductor drum 10, in which the toner image is transferred to the intermediate transfer belt 50, is removed by the cleaning device 60, and a charge on the surface of the photoconductor drum 10 is eliminated by the charge-eliminating lamp 70.

Figure 6:
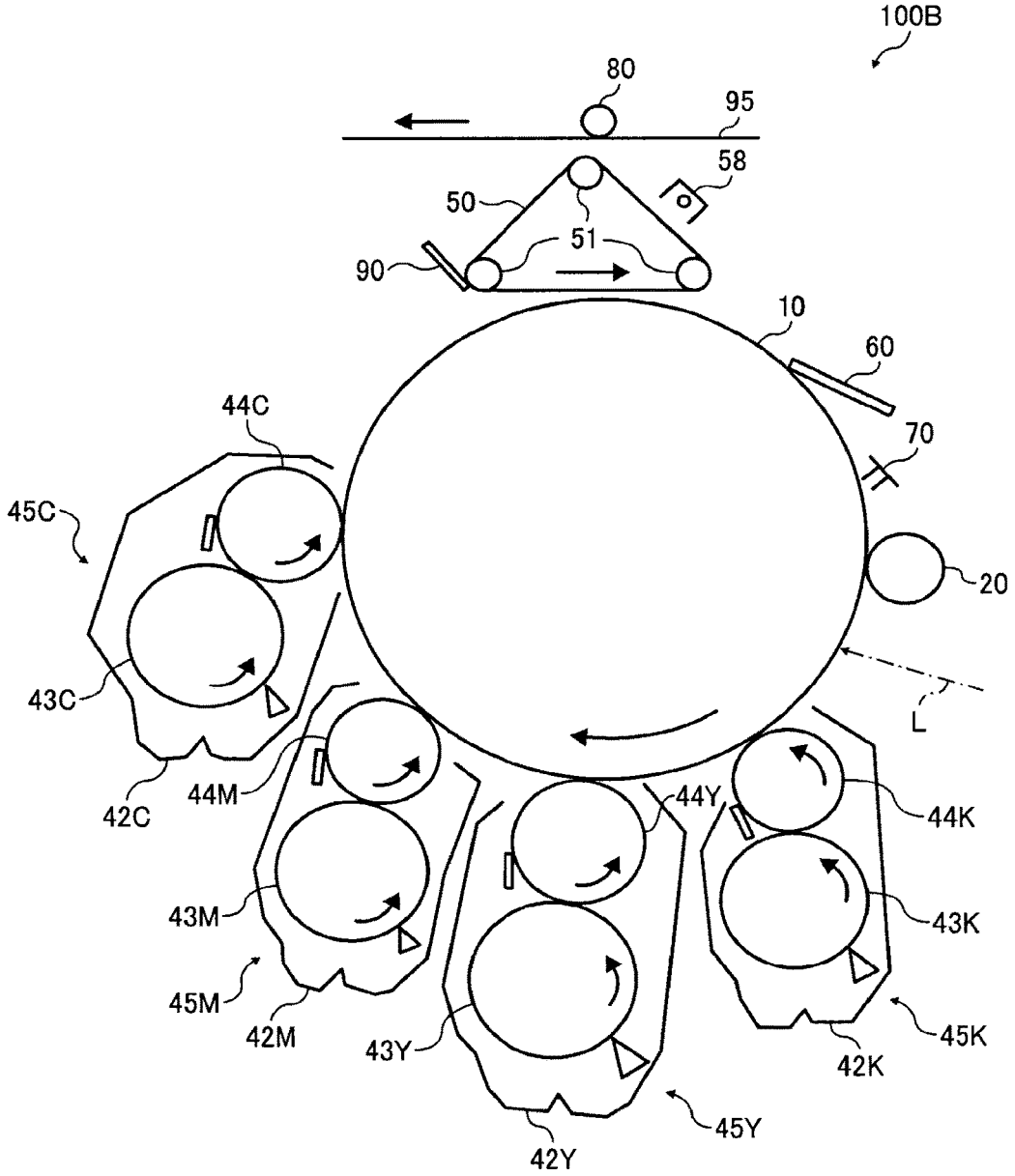
FIG. 6 is a schematic explanatory diagram illustrating another embodiment of the image forming apparatus of the present invention.

FIG. 6 is a second example of an image forming apparatus used in the present invention. An image forming apparatus 100B has the same configuration as the image forming apparatus 100A, except that the developing belt 41 is not disposed, and that the black developing unit 45K, the yellow developing unit 45Y, the magenta developing unit 45M, and the cyan developing unit 45C are disposed directly facing the periphery of the photoconductor drum 10.

Figure 7:
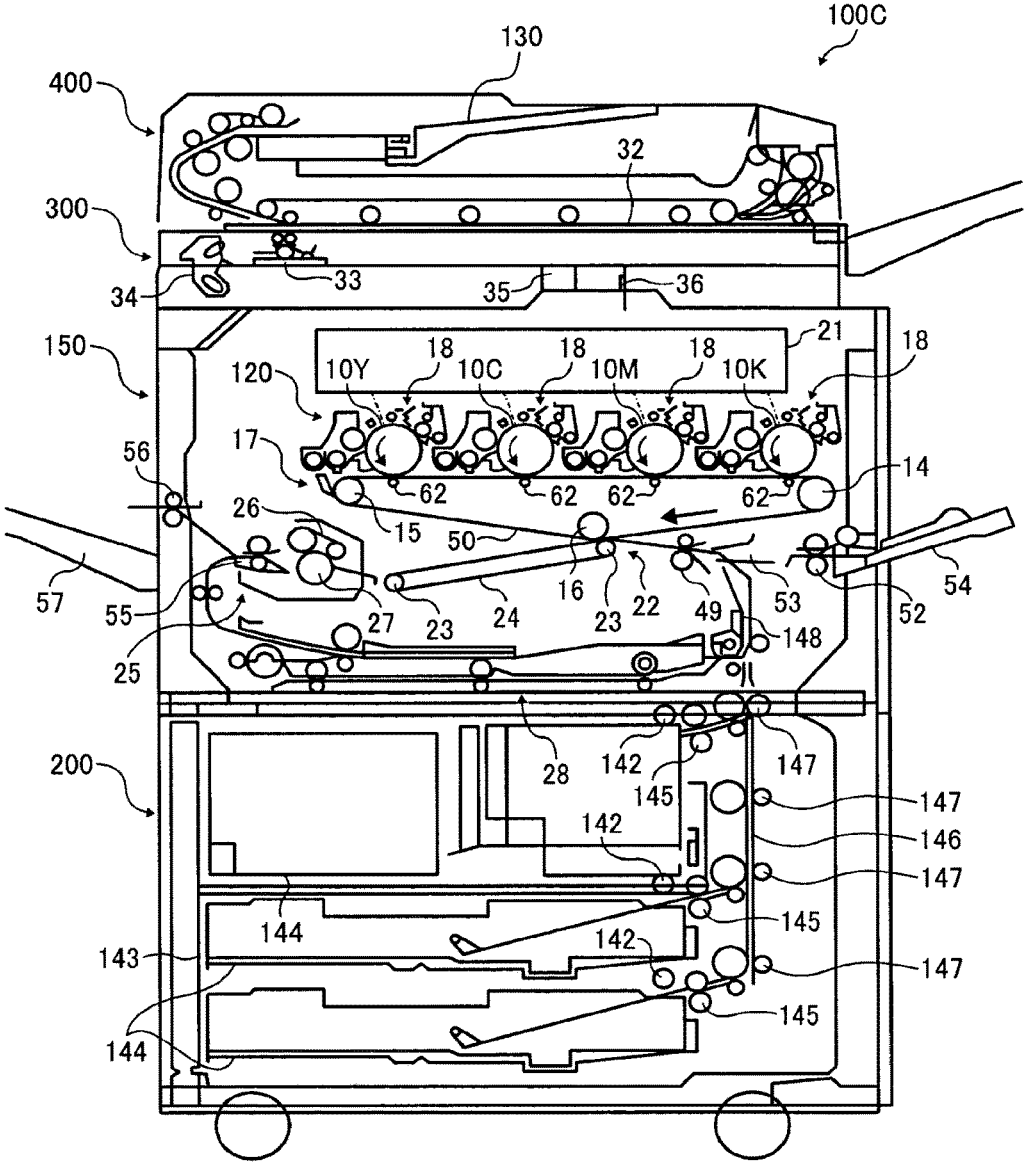
FIG. 7 is a schematic explanatory diagram illustrating a further embodiment of the image forming apparatus of the present invention.
Figure 8:
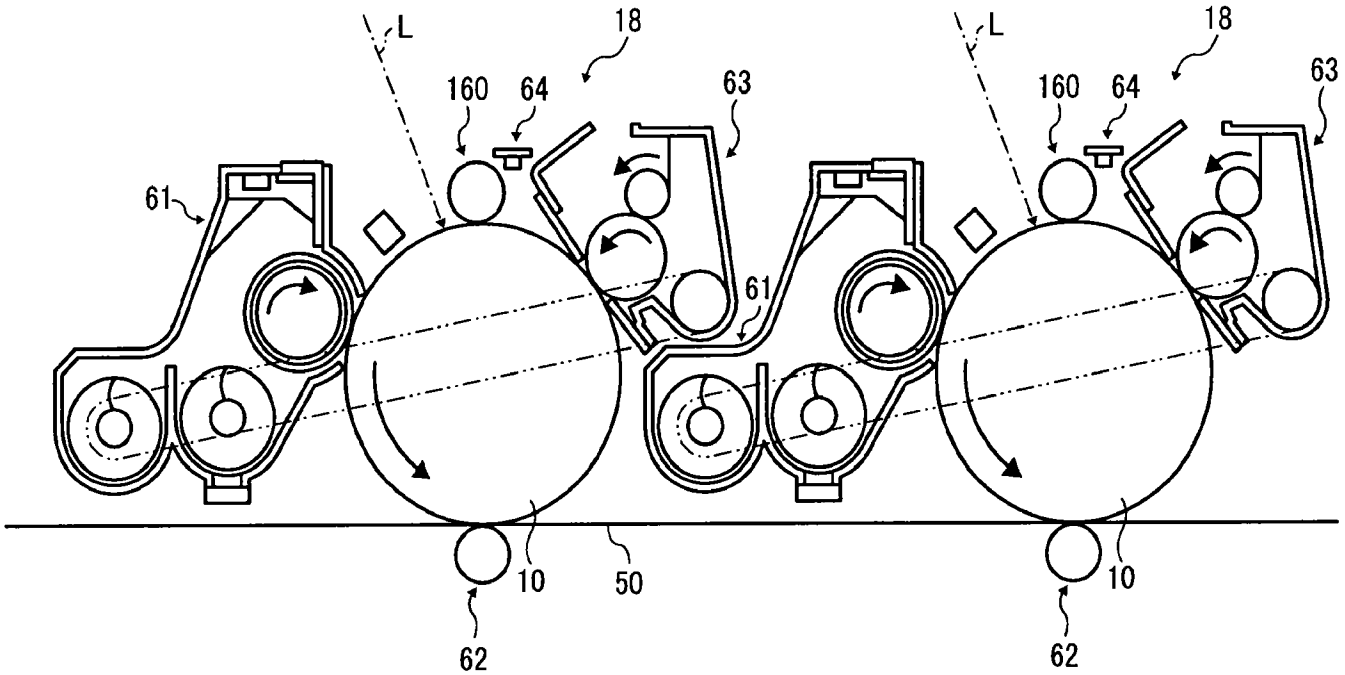
FIG. 8 is a schematic explanatory diagram illustrating another embodiment of the image forming apparatus of the present invention.

FIG. 7 illustrates a third example of an image forming apparatus used in the present invention. The image forming apparatus 100C is a tandem color image forming apparatus, and includes a copying device main body 150, a paper feeding table 200, a scanner 300, and an automatic document feeder (ADF) 400.

An intermediate transfer belt 50, which is an endless belt type, is disposed at a central part of the copying device main body 150. The intermediate transfer belt 50 is stretched around three rollers 14, 15, and 16, and can rotate in the direction indicated by the arrow in figures. Near the roller 15, a cleaning device 17 including a cleaning blade is disposed, and is configured to remove a residual toner on the intermediate transfer belt 50 in which the toner image is transferred to the recording paper. Image forming units for four colors (yellow, cyan, magenta, and black) 120Y, 120C, 120M, and 120K are aligned in the conveying direction so as to face the intermediate transfer belt 50 stretched around rollers 14 and 15.

Near the image forming unit 120, an exposing device 21 is disposed. Moreover, a secondary transfer belt 24 is disposed opposite to a side where the image forming unit 120 of the intermediate transfer belt 50 is disposed. The secondary transfer belt 24, which is an endless belt, is stretched around a pair of rollers 23. The recording paper conveyed on the secondary transfer belt 24 and the intermediate transfer belt 50 can contact each other between the roller 16 and the roller 23.

Near the secondary transfer belt 24, a fixing device 25 is disposed. The fixing device 25 includes a fixing belt 26 and a press roller 27, where the fixing belt 26, which is an endless belt, is stretched around a pair of rollers, and the press roller 27 is disposed so as to be pressed against the fixing belt 26. Here, a sheet inverting device 28 configured to invert the recording paper is disposed near the secondary transfer belt 24 and the fixing device 25, in order to form an image on both sides of the recording paper.

Next, a method for forming a full-color image using the image forming apparatus 100C will be described hereinafter. First, a color document is set on a document table 130 of the automatic document feeder (ADF) 400, or the automatic document feeder 400 is opened to set the color document on a contact glass 32 of the scanner 300, and the automatic document feeder 400 is closed.

When a start button is pushed, in the case where the color document has been set on the automatic document feeder 400, the color document is conveyed and transferred to the contact glass 32, and then the scanner 300 activates. Meanwhile, in the case the color document has been set on the contact glass 32, the scanner 300 activates immediately after that. Then, a first travelling body 33 including a light source and a second travelling body 34 including a mirror travel. At this time, the first travelling body 33 irradiates the document with light to form reflected light, the reflected light is reflected at the second travelling body 34, and then the reflected light is received at a reading sensor 36 through an imaging forming lens 35. Thus, the color document is read, to obtain black, yellow, magenta and cyan image information.

Each image information is transmitted to the image forming unit 120 for each color, to form a toner image for each color. As illustrated in FIG. 5, the image forming unit 120 for each color includes: a photoconductor drum 10; a charging roller 160 configured to uniformly charge the photoconductor drum 10; an exposing device configured to expose the photoconductor drum 10 to exposing light L based on image information for each color, to form an electrostatic latent image corresponding to form a color image; a developing device 61 configured to develop the electrostatic latent image with the toner for each color, to form a toner image of each of the color toners; a transfer roller 62 configured to transfer the toner image on the intermediate transfer belt 50; a cleaning device 63 including a cleaning blade; and a charge-eliminating lamp 64.

The toner image for each color formed on the image forming unit 120 for each color is transferred (primarily transferred), and are superposed on top of one another on an intermediate transfer member 50, which is stretched around rollers 14, 15, and 16, and is movable, to form a composite color image.

Meanwhile, on the paper feeding table 200, one of paper feeding rollers 142 is selectively rotated to feed a recording paper from one of the paper feeding cassettes 144 equipped in multiple stages in a paper bank 143. The sheet is separated one by one by a separation roller 145 and sent to a paper feeding path 146. The recording paper is conveyed by a conveying roller 147 and is guided to a paper feeding path 148 in the copying device main body 150, and stops by colliding with a registration roller 49. Alternatively, the paper feeding roller 142 is rotated to feed a recording paper on a manual feed tray 54. The recording paper is separated one by one by a separation roller 52 and is guided to a manual paper feeding path 53, and stops by colliding with the registration roller 49. Note that, the registration roller 49 is generally used so as to be grounded, but it may also be used in a state that a bias is being applied for removing paper dust particles on the recording medium.

Next, the registration roller 49 is rotated in accordance with the timing of the composite toner image formed on the intermediate transfer belt 50, the recording paper is fed to between the intermediate transfer belt 50 and the secondary transfer belt 24, to transfer (secondarily transfer) the composite toner image on the recording medium. Notably, a residual toner remaining on the intermediate transfer belt 50, in which the composite toner is transferred thereto, is removed by the cleaning device 17.

The recording medium on which the composite toner image is transferred is conveyed by the secondary transfer belt 24, and then the composite toner image is fixed by the fixing device 25. Next, a conveying path is switched by a switching claw 55, and the recording medium is discharged in a paper ejection tray 57 by a discharge roller 56. Alternatively, a conveying path is switched by the switching claw 55, and the recording medium is inverted by the inverting device 28, to form an image on the rear surface of the recording medium. Then the recording medium is discharged in the paper ejection tray 57 by the discharge roller 56.

An image forming apparatus of the present invention can provide an image having high quality for a long term.

EXAMPLES

Examples of the present invention now will be described, but the present invention is not limited thereto. In the following description, "%" means "% by mass" and "part(s)" means "part(s) by mass," unless otherwise stated.

Synthetic Example A-1

—Synthesis of Polyester Resin A-1—

A reaction container equipped with a nitrogen inlet tube, a water outlet tube, a stirrer, and a thermocouple was charged with bisphenol A propylene oxide 2 mol adduct and bisphenol A propylene oxide 3 mol adduct in a molar ratio of 80/20 (bisphenol A propylene oxide 2 mol adduct/bisphenol A propylene oxide 3 mol adduct), and isophthalic acid and adipic acid in a molar ratio of 70/30 (isophthalic acid/adipic acid) so as to be OH/COOH=1.33, followed by reacting together with 500 ppm of titanium tetraisopropoxide under normal pressure at 230° C. for 10 hrs to thereby obtain a reaction product, followed by reacting under reduced pressure of a range of from 10 mmHg through 15 mmHg for 5 hrs. Thereafter, the reaction container was added with 11 parts of trimellitic anhydride, followed by reacting under normal pressure at 180° C. for 3 hrs to thereby obtain a [polyester resin A-1].

Synthetic Example A-2

—Synthesis of Polyester Resin A-2—

A reaction container equipped with a nitrogen inlet tube, a water outlet tube, a stirrer, and a thermocouple was charged with bisphenol A propylene oxide 2 mol adduct and bisphenol A propylene oxide 3 mol adduct in a molar ratio of 80/20 (bisphenol A propylene oxide 2 mol adduct/bisphenol A propylene oxide 3 mol adduct), and isophthalic acid and adipic acid in a molar ratio of 70/30 (isophthalic acid/adipic acid) so as to be OH/COOH=1.33, followed by reacting together with 500 ppm of titanium tetraisopropoxide under normal pressure at 230° C. for 10 hrs to thereby obtain a reaction product. Then, the reaction container was added with 16 parts of benzoic acid, followed by reacting under reduced pressure of a range of from 10 mmHg through 15 mmHg for 5 hrs. Thereafter, the reaction container was added with 11 parts of trimellitic anhydride, followed by reacting under normal pressure at 180° C. for 3 hrs to thereby obtain a [polyester resin A-2].

Synthetic Example A-3

—Synthesis of Polyester Resin A-3—

The procedure for preparation of the polyester resin A-2 was repeated except for changing 16 parts of benzoic acid into 21 parts thereof to obtain a [polyester resin A-3].

Synthetic Example A-4

—Synthesis of Polyester Resin A-4—

The procedure for preparation of the polyester resin A-2 was repeated except for changing 16 parts of benzoic acid into 26 parts thereof to obtain a [polyester resin A-4].

(DSC Measurement)

A glass transition temperature Tg of each of the polyester resins A1 to A4 was measured with DSC-6220R (manufactured by Seiko Instruments Inc.). A sample was heated from room temperature to 150° C. at a temperature rising rate of 10° C./min (first temperature rising); left to stand at 150° C. for 10 min; cooled to room temperature; left to stand at room temperature for 10 min; and then heated again to 150° C. at a temperature rising rate of 10° C./min (second temperature rising). In the resultant DSC curve, the glass transition temperature can be determined from the base line at a temperature equal to or lower than the glass transition temperature and a curved line portion at a height which corresponds to ½ of the distance from the base line at a temperature equal to or lower than the glass transition temperature to the base line at a temperature equal to or higher than the glass transition temperature.

(GPC Measurement)

A GPC measurement was performed on each of the polyester resins A1 to A4 as follows.

Gel permeation chromatography (GPC) measuring device: GPC-8220GPC (manufactured by Tosoh Corporation)

Column: TSK-GEL SUPER HZ2000, TSK-GEL SUPER HZ2500, and TSK-GEL SUPER HZ3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner was dissolved in THF (containing a stabilizer, manufactured by Wako Pure Chemical Industries, Ltd.) at 0.15% by weight, followed by filtering through a 0.45 μm filter. The resultant filtrate was used as the sample.

The measurement was performed by injecting a range of from 10 μL through 200 μL of the THF sample solution. As for the measurement of the sample, a molecular weight of the sample was calculated from the relationship between the number of counts and the logarithmic value of the calibration curve prepared from several monodispersed polystyrene standard samples.

As for the polystyrene standard sample for preparing the calibration curve, for example, polystyrene standard samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (manufactured by Pressure Chemical Company or Tosoh Corporation) were used. As for a detector, a refractive index (RI) detector was used.

For the GPC measurement results, a molecular weight distribution curve was plotted by taking an intensity as a vertical axis and a molecular weight as a horizontal axis to determine a weight-average molecular weight (Mw) and a weight-average molecular weight (Mw)/a number-average molecular weight (Mn).

(Measurement of Acid Value and Hydroxyl Value)

The acid value AV [KOH mg/g] and the hydroxyl value OHV [KOH mg/g] of each of the polyester resins A1 to A4 were measured according to JIS K0070-1992 and JIS K0070-1966, respectively.

The measurement results are shown in Table 1.

TABLE 1

| Polyester Resin | Tg (° C.) | Mw | Mw/Mn | AV (KOH mg/g) | OHV (KOH mg/g) |
|---|---|---|---|---|---|
| A-1 | 45 | 4500 | 2.3 | 12 | 48 |
| A-2 | 45 | 4500 | 2.2 | 13 | 23 |
| A-3 | 45 | 4500 | 2.3 | 13 | 16 |
| A-4 | 45 | 4500 | 2.3 | 12 | 8 |

Synthetic Example B-1

—Synthesis of Polyester Resin B-1—

Crystalline polylactic acid "N-3000" (manufactured by Nature Works LLC) was placed into a tray (35 cm×25 cm), which was left to stand under an environment of a temperature of 80° C. and a humidity of 95% for 48 hrs, to thereby obtain [polyester resin B-1] having a melting point of 65° C.

Synthetic Example B-2

—Synthesis of Polyester Resin B-2—

A reaction vessel equipped with a cooling tube, a stirrer, and a nitrogen inlet tube was charged with monomer components, i.e., sebacic acid, adipic acid, and 1, 4-butanediol in a molar ratio of 40/9/51 (sebacic acid/adipic acid/1, 4-butanediol). To the reaction vessel, was added 0.25 parts of titanium dihydroxy bis(triethanol aminate) as a condensation catalyst relative to 100 parts of the monomer components, followed by reacting under a nitrogen stream at 180° C. for 4 hrs with generated water being distilled off, then reacting under a nitrogen stream for 2.5 hrs while gradually heating to 225° C. with generated water and 1, 4-butanediol being distilled off, and further reacting under reduced pressure of a range of from 5 mmHg through 20 mmHg until the weight-average molecular weight (Mw) reached about 1,000, to thereby obtain a crystalline resin.

Then, 218 parts of the resultant crystalline resin was transferred into a reaction vessel equipped with a cooling tube, a stirrer, and a nitrogen inlet tube. To the reaction vessel, were added 250 parts of ethyl acetate, 40 parts of hexamethylene diisocyanate (HDI), and 25 parts of maleic anhydride, followed by reacting under a nitrogen stream at 80° C. for 5 hrs. Then, ethyl acetate was distilled off under reduced pressure, to thereby obtain a [polyester resin B-2] having a melting point of 51° C.

Synthetic Example B-3

—Synthesis of Polyester Resin B-3—

A reaction vessel equipped with a cooling tube, a stirrer, and a nitrogen inlet tube was charged with monomer components, i.e., sebacic acid, adipic acid, and 1, 4-butanediol in a molar ratio of 40/9/51 (sebacic acid/adipic acid/1, 4-butanediol). To the reaction vessel, was added 0.25 parts of titanium dihydroxy bis(triethanol aminate) as a condensation catalyst relative to 100 parts of the monomer components, followed by reacting under a nitrogen stream at 180° C. for 4 hrs with generated water being distilled off, then reacting under a nitrogen stream for 3 hrs while gradually heating to 225° C. with generated water and 1, 4-butanediol being distilled off, and further reacting under reduced pressure of a range of from 5 mmHg through 20 mmHg until the weight-average molecular weight (Mw) reached about 1,200, to thereby obtain a crystalline resin.

Then, 218 parts of the resultant crystalline resin was transferred into a reaction vessel equipped with a cooling tube, a stirrer, and a nitrogen inlet tube. To the reaction vessel, were added 250 parts of ethyl acetate, 40 parts of hexamethylene diisocyanate (HDI), and 25 parts of maleic anhydride, followed by reacting under a nitrogen stream at 80° C. for 5 hrs. Then, ethyl acetate was distilled off under reduced pressure, to thereby obtain a [polyester resin B-3] having a melting point of 58° C.

Synthesis Example C

—Synthesis of Polyester Prepolymer—

Seven hundred twenty (720) parts of an adduct of bisphenol A with 2 moles of ethyleneoxide, 90 parts of an adduct of bisphenol A with 2 moles of propyleneoxide, 290 parts terephthalic acid, and 1 part of tetrabutoxytitanate were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 7 hrs to prepare an [intermediate polyester resin].

The [intermediate polyester resin] had a weight-average molecular weight of 9,300.

Next, 400 parts of the [intermediate polyester resin], 95 parts of isophoronediisocyanate and 500 parts of ethyl acetate were reacted in a reactor vessel including a cooling pipe, a stirrer and a nitrogen inlet pipe for 8 hrs at 80° C. to prepare a 50% by mass ethyl acetate solution of [polyester prepolymer] having an isocyanate group at the terminal. The polyester prepolymer included a free isocyanate in an amount of 1.47% by mass.

(Preparation of Masterbatch 1)

HENSCHEL MIXER (manufactured by NIPPON COKE & ENGINEERING COMPANY, LIMITED) was charged with 1,200 parts of water, 540 parts of carbon black (PRINTEX35, manufactured by Evonik Industries AG) [DBP oil absorption=42 mL/100 mg, pH=9.5], and 1,200 parts of the [polyester resin A-1], followed by mixing together to thereby obtain a mixture. The mixture was kneaded at 150° C. for 30 min using a two-roll mill, followed by being roll-cooled and pulverized with a pulverizer to thereby obtain a [masterbatch 1].

(Preparation of Silica Fine Particles 1)

A glass reaction vessel having a capacity of 2 L, equipped with a stirring blade, a dripping nozzle and a thermometer was charged with 600 parts of methanol, 95 parts 10% ammonia water, and the mixture was stirred and mixed to obtain an alkaline catalyst solution (1). The alkaline catalyst solution (1) included an ammonia catalyst ($NH_3$ [mol]/($NH_3$+methanol+water) [L]) of 0.62 mol/L.

Next, the temperature of the alkaline catalyst solution (1) was controlled to be 25° C., and the alkaline catalyst solution (1) was substituted with nitrogen. Then, while the alkaline catalyst solution (1) was stirred at 120 rpm, dripping 300 parts of tetramethoxysilane (TMOS) and 180 parts of ammonia water having a ($NH_3$) concentration of 4.4% were started at the same time at the following rates for 20 min to obtain a suspension liquid of inorganic fine particles. The tetramethoxysilane (TMOS) was fed 15 g/min relative to total mol of methanol in the alkaline catalyst solution (1). The ammonia water having a ($NH_3$) concentration of 4.4% was 9.0 g/min relative to total of the tetramethoxysilane fed per 1 min.

Then, 250 parts of the solvent in the suspension liquid of inorganic fine particles were removed by heating distillation, followed by adding 250 parts of pure water. Then, the suspension liquid was subjected to freeze drier to be dried to obtain a deformed [inorganic fine particles 1']

Twenty (20) parts of trimethylsilane were added to 100 parts of the [inorganic fine particles 1'] and reacted at 150° C. for 2 hrs to obtain a deformed hydrophobized inorganic fine particles, which were [inorganic fine particles 1]. The [inorganic fine particles 1] were classified with a classifier to obtain [silica fine particles 1] having a sharp particle diameter distribution and a volume-average particle diameter of 177 nm.

(Preparation of Silica Fine Particles 2)

The procedure for preparation of the silica fine particles 1 was repeated except for dripping 225 parts of tetramethoxysilane (TMOS) and 120 parts of ammonia water having a ($NH_3$) concentration of 4.4%, and that the ammonia water having a ($NH_3$) concentration of 4.4% was 7.5 g/min relative to total of the tetramethoxysilane fed per 1 min to prepare [inorganic fine particles 2]. The [inorganic fine particles 2] were classified with a classifier to obtain [silica fine particles 2] having a sharp particle diameter distribution and a volume-average particle diameter of 170 nm.

(Preparation of Silica Fine Particles 3)

The procedure for preparation of the silica fine particles 1 was repeated except for dripping 150 parts of tetramethoxysilane (TMOS) and 60 parts of ammonia water having a ($NH_3$) concentration of 4.4%, and that the ammonia water having a ($NH_3$) concentration of 4.4% was 6.0 g/min relative to total of the tetramethoxysilane fed per 1 min to prepare [inorganic fine particles 3]. The [inorganic fine particles 3] were classified with a classifier to obtain [silica fine particles 3] having a sharp particle diameter distribution and a volume-average particle diameter of 165 nm.

Example 1

<Preparation of Toner>

| (Composition of Raw Materials) | |
|---|---|
| Binder Resin 1: [Polyester Resin A-1] | 94 parts |
| Binder resin 2: [Polyester Resin B] | 0 parts |
| Colorant: [Masterbatch 1] | 7 parts |

-continued

| (Composition of Raw Materials) | |
|---|---|
| Charging Control Agent: BONTRON E-84 (manufactured by ORIENT CHEMICAL INDUSTRIES CO., LTD.) | 1 part |
| Release Agent: Carnauba wax (WA-05, manufactured by CERARICA NODA Co., Ltd.) | 6 parts |

The above described raw materials of toner powder were mixed well by a super mixer (SMV-200, manufactured by KAWATA MFG CO., Ltd.) to thereby obtain a toner-powder raw-material mixture. The toner-powder raw-material mixture was supplied to a raw material supplying hopper of Buss co-kneader (TCS-100, manufactured by Buss Co., Ltd.) to knead at a supply rate of 120 kg/h. The resultant kneaded product was roll-cooled on a double belt cooler, coarsely pulverized in a hammer mill, finely pulverized in a jet-stream pulverizer (I-20 jet mill, manufactured by Nippon Pneumatic Mfg. Co., Ltd.), and then finely classified by a wind-driven classifier (DS-20•DS-10 classifier, manufactured by Nippon Pneumatic Mfg. Co., Ltd.), to thereby produce [toner base particles 1].

—Mixing—

To the [toner base particles 1], 1.0 part relative to 100 parts of the [toner base particles 1]hydrophobic silica (HDK-2000, manufactured by Wacker Chemie AG) was added and 3.0 parts of the [silica fine particles 1], totally 4.0 parts of silica were added, followed by mixing with 20 L HENSCHEL MIXER (manufactured by NIPPON COKE & ENGINEERING COMPANY, LIMITED) at a circumferential velocity of 50 m/s for 5 min while cooling the inside of the mixer with 30% ethylene glycol water having a temperature of −5° C. flown in the jacket, and sieving through a 500 mesh sieve to thereby obtain a [toner 1].

Example 2

The procedure for preparation of the [toner 1] in Example 1 was repeated except for changing the amount of the [silica fine particles 1] into 3.5 parts, totally 4.5 parts of silica to obtain a [toner 2].

Example 3

The procedure for preparation of the [toner 1] in Example 1 was repeated except for changing the amount of the [silica fine particles 1] into 2.5 parts, totally 3.5 parts of silica to obtain a [toner 3].

Example 4

The procedure for preparation of the [toner 1] in Example 1 was repeated except for replacing the [polyester resin A-1] with the [polyester resin A-2] as the binder resin 1, and mixing at a circumferential velocity of 33 m/s for 5 min while flowing cooling water having a temperature of 10° C. in the jacket to obtain a [toner 4].

Example 5

The procedure for preparation of the [toner 4] in Example 4 was repeated except for replacing the [polyester resin A-2] with the [polyester resin A-3] as the binder resin 1 to obtain a [toner 5].

Example 6

The procedure for preparation of the [toner 4] in Example 4 was repeated except for replacing the [polyester resin A-2] with the [polyester resin A-4] as the binder resin 1 to obtain a [toner 6].

Example 7

The procedure for preparation of the [toner 4] in Example 4 was repeated except for replacing the [polyester resin A-2] with 87 parts of the [polyester resin A-4] as the binder resin land 7 parts of the [polyester resin B-1] as the binder resin 2 to obtain a [toner 7].

Example 8

The procedure for preparation of the [toner 7] in Example 7 was repeated except for replacing the [polyester resin B-1] with the [polyester resin B-2] as the binder resin 2 to obtain a [toner 8].

Example 9

The procedure for preparation of the [toner 7] in Example 7 was repeated except for replacing the [polyester resin B-1] with the [polyester resin B-3] as the binder resin 2 to obtain a [toner 9].

Example 10

The procedure for preparation of the [toner 9] in Example 9 was repeated except for replacing the [silica fine particles 1] with the [silica fine particles 2] to obtain a [toner10].

Example 11

The procedure for preparation of the [toner 9] in Example 9 was repeated except for replacing the [silica fine particles 1] with the [silica fine particles 3] to obtain a [toner11].

Example 12

The procedure for preparation of the [toner 10] in Example 10 was repeated except for changing the amount of the [silica fine particles 2] into 3.5 parts, totally 4.5 parts of silica to obtain a [toner 12].

Example 13

The procedure for preparation of the [toner 10] in Example 10 was repeated except for changing the amount of the [silica fine particles 2] into 2.5 parts, totally 3.5 parts of silica to obtain a [toner 13].

Example 14

The procedure for preparation of the [toner 12] in Example 12 was repeated except for mixing at a circumferential velocity of 50 m/s for 5 min while flowing 30% ethylene glycol water having a temperature of −5° C. in the jacket to obtain a [toner 14].

Example 15

The procedure for preparation of the [toner 13] in Example 13 was repeated except for mixing at a circumferential velocity of 50 m/s for 5 min while flowing 30% ethylene glycol water having a temperature of −5° C. in the jacket to obtain a [toner 15].

Example 16

—Preparation of Release Agent Dispersion—

A reaction vessel equipped with a condenser, a thermometer, and a stirrer was charged with 70 parts by weight of carnauba wax (WA-05, manufactured by CERARICA NODA Co., Ltd.), 140 parts of the [polyester resin A-1] and 290 parts of ethyl acetate, and the resulting mixture was heated to 75° C., followed by keeping 75° C. for 1.5 hrs with stirring. Then, the resultant was cooled to 30° C. in 1 hr and subjected to wet pulverization by means of ULTRA VISCOMILL (of AIMEX CO., Ltd.) under the following conditions: a liquid feed rate of 5 Kg/hr, disc circumferential velocity of 6 m/sec, 0.5 mm-zirconia beads packed to 80% by volume, and 3 passes, to thereby obtain a [release agent dispersion].

—Preparation of Oil Phase 1—

A container equipped with a thermometer and a stirrer was charged with 113 parts of the [polyester resin A-1], 88 parts of the [release agent dispersion], 42 parts of the [masterbatch 1] and 150 parts by weight of ethyl acetate, and the resulting mixture was pre-dispersed by the stirrer, followed by stirring by means of TK Homomixer (of Tokushu Kika Kogyo Co., Ltd.) at 5,000 rpm to uniformly dissolve and disperse the contents, to thereby obtain an [oil phase 1].

—Preparation of Aqueous Dispersion of Rein Particles—

In a reactor vessel including a stirrer and a thermometer, 600 parts of water, 120 parts of styrene, 100 parts of methacrylate, 45 parts of butylacrylate and 10 parts of a sodium salt of alkyl allyl sulfosuccinate (ELEMINOL JS-2 from Sanyo Chemical Industries, Ltd.) and 1 part of persulfate ammonium were mixed, and the mixture was stirred for 20 min at 400 rpm to prepare a white emulsion. The white emulsion was heated to have a temperature of 75° C. and reacted for 6 hrs. Further, 30 parts of an aqueous solution of persulfate ammonium having a concentration of 1% were added thereto and the mixture was reacted at 75° C. for 6 hrs to prepare an [aqueous dispersion of resin particles]. The resin particles included therein had a volume-average particle diameter of 60 nm, a weight-average molecular weight of 140,000 and a Tg of 73° C.

—Preparation of Aqueous Phase—

Nine hundred and ninety (990) parts of ion-exchanged water, 83 parts of the [aqueous dispersion of resin particles], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare an [aqueous phase].

—Emulsification or Dispersion—

Three hundred and ninety three (393) parts of the [oil phase 1], 58 parts of an ethyl acetate solution of the [polyester prepolymer] and 3.5 parts of a 50% ethyl acetate solution of isophorone diamine were uniformly dissolved and dispersed by TK Homomixer (from Tokushu Kika Kogyo Co., Ltd.) at 5,000 rpm to obtain an [oil phase 1']. Next, a separate container equipped with a stirrer and a thermometer was charged with 550 parts of the [aqueous phase] and the [oil phase 1'] while mixed by TK Homomixer (from Tokushu Kika Kogyo Co., Ltd.) at 11,000 rpm for 1 min to obtain an [emulsified slurry 1].

—Desolvating, Washing and Drying—

A container equipped with a stirrer and a thermometer was charged with the [emulsified slurry 1], and the solvent was removed therefrom over the period of 8 hrs at 30° C., to thereby obtain a [slurry 1]. The [slurry 1] was kept for 4 hrs at 40° C., and then filtered under reduced pressure, and washed.

(1): ion-exchanged water (100 parts) was added to the filtration cake, followed by mixing with TK Homomixer (at 6,000 rpm for 5 min) and then filtered;

(2): ion-exchanged water (100 parts) was added to the filtration cake obtained in (1), subjected to mixing with TK Homomixer (at 6,000 rpm for 5 min), 1% hydrochloric acid was added thereto to have a pH about 3.3 while stirred for 1 hr and filtered;

(3): ion-exchanged water (300 parts) was added to the filtration cake obtained in (2), subjected to mixing with TK Homomixer (at 6,000 rpm for 5 min) and then filtered, which was performed twice to obtain a filtration cake 1.

The filtration cake 1 was dried by means of an air-circulating drier for 48 hrs at 40° C., followed by passed through a sieve with a mesh size of 75 μm, to thereby produce [toner base particles 16].

The toner base particles 16 were mixed in the same manner as that of Examples 1 to obtain a [toner 16]].

Example 17

—Preparation of Crystalline Polyester Dispersion—

A metallic 2 L container was charged with 100 parts of the [polyester resin B-2] and 400 parts of ethyl acetate, and the resin was dissolved at 70° C. The solution was cooled to 20° C. in iced water at 20° C./min to observe crystalline polyester was recrystallized. In the solution after cooled, 100 parts of the [polyester resin A-4] were dissolved and subjected to wet pulverization by means of ULTRA VISCOMILL (of AMEX CO., Ltd.) under the following conditions: a liquid feed rate of 10 Kg/hr, disc circumferential velocity of 6 m/sec, 0.5 mm-zirconia beads packed to 80% by volume, and 5 passes, to thereby obtain a [crystalline polyester dispersion].

—Preparation of Oil Phase 2—

A container equipped with a thermometer and a stirrer was charged with 100 parts of the [polyester resin A-4], 88 parts of the [release agent dispersion], 20 parts of the [crystalline polyester dispersion], 42 parts of the [masterbatch 1] and 150 parts by weight of ethyl acetate, and the resulting mixture was pre-dispersed by the stirrer, followed by stirring by means of TK Homomixer (of Tokushu Kika Kogyo Co., Ltd.) at 5,000 rpm to uniformly dissolve and disperse the contents, to thereby obtain an [oil phase 2]. Except these, the procedure for preparation of the toner 10 in Example 10 was repeated to prepare [toner base particles 17] and a [toner 17].

Example 18

The procedure for preparation of the [toner 17] in Example 17 was repeated except for changing the amount of the [silica fine particles 2] into 3.5 parts, totally 4.5 parts of silica to obtain a [toner 18].

Example 19

The procedure for preparation of the [toner 17] in Example 17 was repeated except for changing the amount of the [silica fine particles 2] into 2.5 parts, totally 3.5 parts of silica to obtain a [toner 19].

Comparative Example 1

The procedure for preparation of the [toner 1] in Example 1 was repeated except for mixing at a circumferential velocity of 33 m/s for 5 min while flowing cooling water having a temperature of 10° C. in the jacket to obtain a [toner 20].

Comparative Example 2

The procedure for preparation of the [toner 2] in Example 2 was repeated except for mixing at a circumferential velocity of 33 m/s for 5 min while flowing cooling water having a temperature of 10° C. in the jacket to obtain a [toner 21].

Comparative Example 3

The procedure for preparation of the [toner 3] in Example 3 was repeated except for mixing at a circumferential velocity of 33 m/s for 5 min while flowing cooling water having a temperature of 10° C. in the jacket to obtain a [toner 22].

Comparative Example 4

The procedure for preparation of the [toner 1] in Example 1 was repeated except for changing the amount of the [silica fine particles 1] into 4.0 parts, totally 5.0 parts of silica to obtain a [toner 23].

Comparative Example 5

The procedure for preparation of the [toner 1] in Example 1 was repeated except for changing the amount of the [silica fine particles 1] into 2.0 parts, totally 3.0 parts of silica to obtain a [toner 24].

Comparative Example 6

The procedure for preparation of the [toner 23] in Comparative Example 4 was repeated except for mixing at a circumferential velocity of 33 m/s for 5 min while flowing cooling water having a temperature of 10° C. in the jacket to obtain a [toner 25].

Comparative Example 7

The procedure for preparation of the [toner 24] in Comparative Example 5 was repeated except for mixing at a circumferential velocity of 33 m/s for 5 min while flowing cooling water having a temperature of 10° C. in the jacket to obtain a [toner 26].

Comparative Example 8

The procedure for preparation of the [toner 14] in Example 14 was repeated except for mixing the silica for 10 min to obtain a [toner 27].

Comparative Example 9

The procedure for preparation of the [toner 15] in Example 15 was repeated except for mixing the silica for 10 min to obtain a [toner 28].

Comparative Example 10

The procedure for preparation of the [toner 16] in Example 16 was repeated except for mixing at a circumferential velocity of 33 m/s for 5 min while flowing cooling water having a temperature of 10° C. in the jacket to obtain a [toner 29].

The following measurements were performed on the toners of Examples and Comparative Examples. The results are shown in Table 2.

<GPC Measurement>

A GPC measurement was performed on each of the toners of Examples and Comparative Examples as follows.

Gel permeation chromatography (GPC) measuring device: GPC-8220GPC (manufactured by Tosoh Corporation)

Column: TSK-GEL SUPER HZ2000, TSK-GEL SUPER HZ2500, and TSK-GEL SUPER 14Z3000

Temperature: 40° C.

Solvent: tetrahydrofuran (THF)

Flow rate: 0.35 mL/min

Sample: THF sample solution having a concentration adjusted to 0.15% by mass

Pretreatment of sample: a toner was dissolved in THE (containing a stabilizer, manufactured by Wako Pure Chemical Industries, Ltd.) at 0.15% by weight, followed by filtering through a 0.45 μm filter. The resultant filtrate was used as the sample.

The measurement was performed by injecting a range of from 10 μL through 200 μL of the THF sample solution. As for the measurement of the sample, a molecular weight of the sample was calculated from the relationship between the number of counts and the logarithmic value of the calibration curve prepared from several monodispersed polystyrene standard samples.

As for the polystyrene standard sample for preparing the calibration curve, for example, polystyrene standard samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (manufactured by Pressure Chemical Company or Tosoh Corporation) were used. As for a detector, a refractive index (RI) detector was used.

The measurement results of GPC were plotted on a diagram in which a vertical axis is intensity and a horizontal axis is molecular weight, the maximum intensity in a molecular weight range not greater than 20,000 is 100 to correct strength of an entire molecular weight distribution curve.

A difference between the maximum value and the minimum value of a peak intensity was determined in a range of M±300.

<Average Circularity of Silica>

After silica was mixed with toner particles, the primary particles of the silica were observed with an SEM equipment at 5.0 kV. From the resultant image analysis of the primary particles, the average circularity (100/SF2) of the silica was determined by the following formula:

$$\text{Circularity } (100/SF2)=4\pi\times(A/I^2)$$

wherein I represents a perimeter of the primary particle of the silica; A represents a projected area; and SF2 represents a shape factor.

<<Specific Example of Image Analysis Method of External Additive>>

The image analysis was performed by the following method using an image analysis software LMeye for OPTELICSC130 from Lasertec Corp.

(1) Read an image observed at 5.0 kV with the SEM (2) Adjust calibration (scale)

(3) Perform automatic contrast (4) Reverse (5) Perform edge abstraction (sobel)
(6) Perform edge abstraction (sobel) again
(7) Perform digitalization (discriminant analysis mode)
(8) Calculate shape features such as a circularity, an absolute maximum length and a diagonal width The average circularity of the silica was 50% circularity in an accumulated frequency of projected area diameters of 100 pieces of the primary particles obtained from the above image analysis.

<Silica Releasing from Toner Particle>

Silica releasing from the toner is measured as follows:

(1) 3.75 g of the toner are dispersed in 50 mL of a dispersion including 0.5% by mass of polyoxyalkylene alkyl ether in a 110 mL vial;

(2) the dispersion is irradiated with an ultrasonic wave by a ultrasonic homogenizer VCX750, CV33 from Sonics & Materials, Inc. at a frequency of 20 kHz and a power of 80 W for a fixed time, the power and the irradiation time are multiplied to determine an energy amount, and the dispersion is timely cooled so as not to have a temperature not less than 40° C.

(3) the resultant dispersion is subjected to filtration under reduced pressure with a filter paper (qualitative filter paper No. 2, 110 mm from ADVANTEC), washed twice with ion exchanged water, filtered to remove released silica, and the toner is dried; and (4) amounts of silica before and after removed are determined by measuring % by mass from an intensity of a calibration curve (or a difference of intensities before and after the external additive is removed) with an X-ray fluorescence analyzer ZSX-100e from Rigaku Corp. to determine an amount of free silica.

$$\text{Free Amount}=(\text{Mass of Silica before Dispersed})-(\text{Mass of Remaining Silica after Dispersed}) \quad \text{[Formula 1]}$$

A free rate (% by mass) of silica is determined by the following formula (2).

$$\text{Free Rate}=[\text{Free Amount}/\text{Total Amount of Silica Added}]\times 100 \quad \text{[Formula 2]}$$

Then, a total amount of silica added is defined as follows.

Amounts of silica of the toner when irradiated with an ultrasonic wave by a ultrasonic homogenizer by the same method as above at irradiation energies of 1,000 kJ and 1,500 kJ are determined by the X-ray fluorescence analyzer to see whether there is no reduction of silica. When there is no reduction of silica, all silica appear free. The surface of a toner after dried may be observed with a field emission-type scanning electron microscope (FE-SEM) to see all silica releases from the toner.

TABLE 2(1)

| | | Preparation Method | Parts of Silica | Mixing Circumferential Velocity (m/s) | Mixing Time (min) | Binder Resin 1 | Binder Resin 2 |
|---|---|---|---|---|---|---|---|
| Example 1 | Toner 1 | Pulverization Method | 4.0 | 50 | 5 | A-1 | — |
| Example 2 | Toner 2 | | 4.5 | 50 | 5 | A-1 | — |
| Example 3 | Toner 3 | | 3.5 | 50 | 5 | A-1 | — |
| Example 4 | Toner 4 | | 4.0 | 33 | 5 | A-2 | — |
| Example 5 | Toner 5 | | 4.0 | 33 | 5 | A-3 | — |
| Example 6 | Toner 6 | | 4.0 | 33 | 5 | A-4 | — |
| Example 7 | Toner 7 | | 4.0 | 33 | 5 | A-4 | B-1 |
| Example 8 | Toner 8 | | 4.0 | 33 | 5 | A-4 | B-2 |
| Example 9 | Toner 9 | | 4.0 | 33 | 5 | A-4 | B-3 |
| Example 10 | Toner 10 | | 4.0 | 33 | 5 | A-4 | B-3 |
| Example 11 | Toner 11 | | 4.0 | 33 | 5 | A-4 | B-3 |
| Example 12 | Toner 12 | | 4.5 | 33 | 5 | A-4 | B-3 |
| Example 13 | Toner 13 | | 3.5 | 33 | 5 | A-4 | B-3 |
| Example 14 | Toner 14 | | 4.5 | 50 | 5 | A-4 | B-3 |
| Example 15 | Toner 15 | | 3.5 | 50 | 5 | A-4 | B-3 |
| Example 16 | Toner 16 | Dissolution Suspension Method | 4.0 | 50 | 5 | A-1 | — |
| Example 17 | Toner 17 | | 4.0 | 33 | 5 | A-4 | B-3 |
| Example 18 | Toner 18 | | 4.5 | 33 | 5 | A-4 | B-3 |
| Example 19 | Toner 19 | | 3.5 | 33 | 5 | A-4 | B-3 |
| Comparative Example 1 | Toner 20 | Pulverization Method | 4.0 | 33 | 5 | A-1 | — |
| Comparative Example 2 | Toner 21 | | 4.5 | 33 | 5 | A-1 | — |
| Comparative Example 3 | Toner 22 | | 3.5 | 33 | 5 | A-1 | — |
| Comparative Example 4 | Toner 23 | | 5.0 | 50 | 5 | A-1 | — |
| Comparative Example 5 | Toner 24 | | 3.0 | 50 | 5 | A-1 | — |
| Comparative Example 6 | Toner 25 | | 5.0 | 33 | 5 | A-1 | — |
| Comparative Example 7 | Toner 26 | | 3.0 | 33 | 5 | A-1 | — |
| Comparative Example 8 | Toner 27 | | 4.5 | 50 | 10 | A-4 | B-3 |
| Comparative Example 9 | Toner 28 | | 3.5 | 50 | 10 | A-4 | B-3 |
| Comparative Example 10 | Toner 29 | Dissolution Suspension Method | 4.0 | 33 | 5 | A-1 | — |

TABLE 2(2)

| | | Energy for releasing silica by 20% (kJ) | Energy for releasing silica by 50% (kJ) | Difference of GPC Peak Intensity | Average Circularity of Silica |
|---|---|---|---|---|---|
| Example 1 | Toner 1 | 8 | 80 | 45 | 0.9 |
| Example 2 | Toner 2 | 8 | 88 | 45 | 0.9 |
| Example 3 | Toner 3 | 9 | 78 | 45 | 0.9 |
| Example 4 | Toner 4 | 8 | 80 | 28 | 0.9 |
| Example 5 | Toner 5 | 9 | 87 | 15 | 0.9 |
| Example 6 | Toner 6 | 9 | 105 | 3 | 0.9 |
| Example 7 | Toner 7 | 9 | 98 | 3 | 0.9 |
| Example 8 | Toner 8 | 9 | 95 | 3 | 0.9 |
| Example 9 | Toner 9 | 9 | 95 | 3 | 0.9 |
| Example 10 | Toner 10 | 10 | 101 | 3 | 0.6 |
| Example 11 | Toner 11 | 11 | 104 | 3 | 0.4 |
| Example 12 | Toner 12 | 10 | 110 | 3 | 0.6 |
| Example 13 | Toner 13 | 11 | 85 | 3 | 0.6 |
| Example 14 | Toner 14 | 12 | 125 | 3 | 0.6 |
| Example 15 | Toner 15 | 14 | 105 | 3 | 0.6 |
| Example 16 | Toner 16 | 8 | 80 | 45 | 0.9 |
| Example 17 | Toner 17 | 10 | 101 | 3 | 0.6 |
| Example 18 | Toner 18 | 10 | 110 | 3 | 0.6 |
| Example 19 | Toner 19 | 11 | 85 | 3 | 0.6 |
| Comparative Example 1 | Toner 20 | 8 | 54 | 45 | 0.9 |
| Comparative Example 2 | Toner 21 | 7 | 60 | 45 | 0.9 |
| Comparative Example 3 | Toner 22 | 8 | 50 | 45 | 0.9 |
| Comparative Example 4 | Toner 23 | 7 | 68 | 45 | 0.9 |
| Comparative Example 5 | Toner 24 | 9 | 48 | 45 | 0.9 |
| Comparative Example 6 | Toner 25 | 7 | 65 | 45 | 0.9 |
| Comparative Example 7 | Toner 26 | 8 | 43 | 45 | 0.9 |
| Comparative Example 8 | Toner 27 | 13 | 135 | 3 | 0.6 |
| Comparative Example 9 | Toner 28 | 15 | 110 | 3 | 0.6 |
| Comparative Example 10 | Toner 29 | 8 | 54 | 45 | 0.9 |

The resultant toners were subjected to the following evaluations. Results are presented in Table 3.

<Low-Temperature Fixability>

An image forming apparatus ("IPSIO COLOR 8100"; manufactured by Ricoh Company, Ltd.), which had been modified and tuned to an oil-less fixing system, was used for evaluation. Sheets of thick paper ("paper for copying and printing <135>"; manufactured by RICOH JAPAN Corp.) were set to the apparatus. The apparatus was adjusted to develop a solid image with a toner at 1.0±0.1 mg/cm$^2$. A fixing roll temperature at which a residual rate of image density after the resultant fixed image was rubbed with a pad was 70% or higher was determined as a fixing lower limit temperature.

[Evaluation Criteria]

Excellent: Fixing lower limit temperature was lower than 110° C.

Good: Fixing lower limit temperature was 110° C. or higher but lower than 125° C.

Fair: Fixing lower limit temperature was 125° C. or higher but lower than 150° C.

Poor: Fixing lower limit temperature was 150° C. or higher.

<Charge Stability>

Durability was tested using each of developing agents. A character and image pattern at an image area rate of 12% was continuously output on 300,000 sheets to evaluate a change of a charging amount before and after the output. A small amount of the developing agent was taken from a sleeve, and the change of the charge amount was determined by the blowoff method and evaluated according to the following evaluation criteria.

[Evaluation Criteria]

Excellent: Change of charge amount is less than 3 μc/g.

Good: Change of charge amount is 3 μc/g or higher but lower than 6 μc/g.

Fair: Change of charge amount is 6 μc/g or higher but lower than 10 μc/g.

Poor: Change of charge amount is 10 μc/g or higher.

<Toner Scattering>

After 80,000 pieces of a chart having an image areal ratio of 20% were continuously produced by a marketed digital full-color printer (imagio MPC6000 producing 50 A4 color images/min from Ricoh Company, Ltd.), toner contamination in the printer was visually observed.

[Evaluation Criteria]

Excellent: No toner contamination was observed

Good: Slight contamination was observed, but was no problem

Fair: Contamination was observed, but within allowance

Poor: Considerable contamination and out of allowance

<Heat Resistant Preservability>

The toners were stored at 50° C. for 8 hrs, followed by sieving through a 42 mesh sieve for 2 min. A residual rate of the toner remaining on the sieve was determined as an index of the heat resistant preservability.

[Evaluation Criteria]

The heat resistant preservability was evaluated according to the following criteria. "Excellent" and "Good" represent a satisfactory level, "Fair" represents a practically acceptable level despite of its slightly poor storability, and "Poor" represents a problematic level as a high-quality toner.

Excellent: lower than 10%

Good: 10 to 20%

Fair: 20 to 30%

Poor: 30% or higher

<Abrasion and Contamination of Photoconductor (Photoconductor Filming)>

Images were produced by an image forming apparatus MP C305SP from Ricoh Company, Ltd., which was modified to change a linear speed of an electrostatic latent image bearer in an image developer under the following conditions. An amount of the developer was 110 g, and the linear speed 300 mm/sec of the electrostatic latent image bearer in the image developer was low speed and 630 mm/sec was high speed.

From 0 to 9,999 at 23° C. and 50% RH, from 10,000 to 19,999 at 28° C. and 85% RH, from 20,000 to 29,999 at 15° C. and 30% RH, every 1,000 pieces of an image having an areal ratio of 5% and an image having an areal ratio of 20% were alternately produced 9 times, i.e., totally 270,000 pieces were produced.

After 270,000 pieces were produced, the photoconductor was observed and whether abnormal dot images were produced was detected.

Abrasion of photoconductor means the photoconductor has a scratch due to a toner, etc. and the photoconductor is abraded in a circumferential direction thereof in a severe case.

[Evaluation Criteria]

Excellent: No abrasion of photoconductor

Good: Slight contamination of photoconductor, but not detected on dot image

Fair: Photoconductor was abraded, but not detected on dot image

Poor: Photoconductor had scratches, and obviously detected on dot image

TABLE 3

| | | Low-Temperature Fixability | Charge Stability | Toner Scattering | Heat Resistant Preservability | Photoconductor Filming (Low Speed) | Photoconductor Filming (High Speed) |
|---|---|---|---|---|---|---|---|
| Example 1 | Toner 1 | Fair | Fair | Fair | Excellent | Fair | Fair |
| Example 2 | Toner 2 | Fair | Good | Fair | Excellent | Fair | Fair |
| Example 3 | Toner 3 | Fair | Fair | Fair | Good | Good | Fair |
| Example 4 | Toner 4 | Good | Fair | Good | Excellent | Fair | Fair |
| Example 5 | Toner 5 | Good | Good | Good | Excellent | Good | Fair |
| Example 6 | Toner 6 | Good | Excellent | Excellent | Excellent | Good | Fair |
| Example 7 | Toner 7 | Good | Excellent | Excellent | Good | Good | Fair |
| Example 8 | Toner 8 | Excellent | Excellent | Excellent | Fair | Good | Fair |
| Example 9 | Toner 9 | Excellent | Excellent | Excellent | Good | Good | Fair |
| Example 10 | Toner 10 | Excellent | Excellent | Excellent | Good | Good | Good |
| Example 11 | Toner 11 | Excellent | Good | Good | Good | Excellent | Good |
| Example 12 | Toner 12 | Good | Excellent | Excellent | Excellent | Good | Fair |
| Example 13 | Toner 13 | Excellent | Good | Good | Good | Excellent | Excellent |
| Example 14 | Toner 14 | Good | Excellent | Excellent | Good | Excellent | Good |
| Example 15 | Toner 15 | Excellent | Excellent | Excellent | Fair | Excellent | Excellent |
| Example 16 | Toner 16 | Fair | Fair | Fair | Excellent | Good | Fair |
| Example 17 | Toner 17 | Excellent | Excellent | Excellent | Good | Good | Good |
| Example 18 | Toner 18 | Good | Excellent | Excellent | Excellent | Good | Fair |
| Example 19 | Toner 19 | Excellent | Fair | Fair | Good | Excellent | Excellent |
| Comparative Example 1 | Toner 20 | Fair | Poor | Poor | Excellent | Good | Fair |
| Comparative Example 2 | Toner 21 | Poor | Good | Fair | Good | Fair | Poor |
| Comparative Example 3 | Toner 22 | Fair | Poor | Poor | Fair | Good | Fair |
| Comparative Example 4 | Toner 23 | Poor | Excellent | Excellent | Excellent | Poor | Poor |
| Comparative Example 5 | Toner 24 | Fair | Poor | Poor | Fair | Excellent | Good |
| Comparative Example 6 | Toner 25 | Poor | Good | Good | Good | Poor | Poor |
| Comparative Example 7 | Toner 26 | Fair | Poor | Poor | Fair | Good | Fair |
| Comparative Example 8 | Toner 27 | Good | Excellent | Excellent | Poor | Good | Good |
| Comparative Example 9 | Toner 28 | Excellent | Excellent | Excellent | Poor | Excellent | Excellent |
| Comparative Example 10 | Toner 29 | Fair | Poor | Poor | Excellent | Good | Fair |

Table 3 proves the toners of Examples 1 to 19 have good storage stability, low-temperature fixability and charge stability. Particularly, the toners of Examples 10 and 17 have better storage stability, low-temperature fixability and charge stability. To the contrary, the toners of Comparative Examples 1 to 10 have practical problems in storage and image stability.

Having now fully described the invention, it will be apparent to one of ordinary skill in the art that many changes and modifications can be made thereto without departing from the spirit and scope of the invention as set forth therein.

What is claimed is:

1. A toner, comprising:

a toner base particle which comprises a binder resin and a release agent; and external additives which comprise two or more inorganic fine particles, wherein at least one of the inorganic fine particles is silica, wherein the binder resin has a group derived from a phenoxy acetic acid or a benzoic acid, the group being a substitute for a hydroxyl group at an end of a chain of the binder resin, and wherein when an ultrasonic oscillation having a frequency of 20 kHz is applied to a dispersion in which 3.75 g of the toner is dispersed in 50 mL of a dispersant which is a mixture of ion exchanged water and 0.5% by mass of polyoxyalkylene alkyl ether dissolved in the ion exchanged water, under a temperature of 40° C. or less, an application energy of the ultrasonic oscillation is from 8 to 14 kJ when a rate of the silica releasing from the toner is 20 mass % based on total silica, and from 70 to 130 kJ when the rate of the silica releasing from the toner is 50 mass % based on the total silica.

2. The toner of claim 1, wherein the content of the silica is from 3.5 to 4.5 parts by mass per 100 parts by mass of the toner base particle.

3. The toner of claim 1, wherein in a molecular weight distribution of tetrahydrofuran(THF)-soluble components of the toner, when a molecular weight M is selected within a molecular weight range of from 300 to 5,000, a difference between the maximum value and the minimum value of a peak intensity in a range of M±300 is not greater than 30, wherein the peak intensity is a relative value when the maximum intensity is set to 100 in a molecular weight range not greater than 20,000 in a molecular weight distribution curve plotted on a diagram in which a vertical axis is intensity and a horizontal axis is molecular weight through GPC measurement.

4. The toner of claim 1, wherein the binder resin comprises a crystalline resin having a melting point of from 50° C. to 65° C.

5. The toner of claim 1, wherein the silica has an average circularity of from 0.4 to 0.8.

6. A developer comprising the toner according to claim 1.

7. A developer housing unit comprising the developer according to claim 6.

8. An image forming apparatus, comprising:

an electrostatic latent mage bearer to bear an electrostatic latent mage;

an electrostatic latent mage former to form an electrostatic latent image on the electrostatic latent mage bearer;

the developer according to claim 6;

an image developer to develop the electrostatic latent image with the developer to form a visible image;

a transferer to transfer the visible image onto a recording medium, and a fixer to fix the visible image on the recording medium.

* * * * *